US010210883B2

(12) United States Patent
Geiger et al.

(10) Patent No.: US 10,210,883 B2
(45) Date of Patent: Feb. 19, 2019

(54) SIGNAL PROCESSING APPARATUS FOR ENHANCING A VOICE COMPONENT WITHIN A MULTI-CHANNEL AUDIO SIGNAL

(71) Applicant: Huawei Technologies Co., Ltd., Shenzhen (CN)

(72) Inventors: Juergen Geiger, München (DE); Peter Grosche, München (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/428,723

(22) Filed: Feb. 9, 2017

(65) Prior Publication Data

US 2017/0154636 A1 Jun. 1, 2017

Related U.S. Application Data

(63) Continuation of application No. PCT/EP2014/077620, filed on Dec. 12, 2014.

(51) Int. Cl.
*G10L 21/0316* (2013.01)
*G10L 21/0272* (2013.01)
(Continued)

(52) U.S. Cl.
CPC ..... *G10L 21/0316* (2013.01); *G10L 21/0272* (2013.01); *H04S 3/008* (2013.01); *H04S 5/00* (2013.01)

(58) Field of Classification Search
CPC ..... G10L 21/0232; G10L 21/0208; G10L 21/0216; G10L 21/0264; G10L 21/0316;
(Continued)

(56) References Cited

U.S. PATENT DOCUMENTS 4,024,344 A * 5/1977 Dolby ..... H04S 5/00 381/27
4,799,260 A * 1/1989 Mandell ..... H04S 3/02 381/22
(Continued)

FOREIGN PATENT DOCUMENTS

CN 104134444 A 11/2014
EP 2191467 B1 6/2011
(Continued)

OTHER PUBLICATIONS

Scheirer et al., "Construction and Evaluation of the Robust Multifeature Speech/Music Discriminator," IEEE International Conference on Acoustics, Speech and Signal Processing, vol. 2, pp. 1331-1334, Institute of Electrical and Electronics Engineers, New York, New York (1997).
(Continued)

*Primary Examiner* — Yogeshkumar Patel
(74) *Attorney, Agent, or Firm* — Leydig, Voit & Mayer, Ltd.

(57) ABSTRACT

A signal processing apparatus for enhancing a voice component within a multi-channel audio signal comprising a left channel audio signal, a center channel audio signal, and a right channel audio signal, the signal processing apparatus comprising a filter and a combiner; wherein the filter is configured to determine an overall magnitude of the multi-channel audio signal over frequency based on the multi-channel audio signal, to obtain a gain function based on a ratio between a magnitude of the center channel audio signal and the overall magnitude of the multi-channel audio signal, and to weight the left channel audio signal, the center channel audio signal, and the right channel audio signal by the gain function; and wherein the combiner is configured to combine individually the left channel audio signal, the
(Continued)

center channel audio signal, and the right channel audio signal with the weighted right channel audio signal.

20 Claims, 7 Drawing Sheets

(51) Int. Cl.
*H04S 3/00* (2006.01)
*H04S 5/00* (2006.01)

(58) Field of Classification Search
CPC . G10L 21/0272; G10L 21/057; G10L 21/034; G10L 25/03; G10L 2021/02082; G10L 2021/02165; G10L 2021/02087; G10L 2021/02085; G10L 2021/02163; H04S 3/008; H04S 5/00
USPC ..... 704/205, 225, 233
See application file for complete search history.

(56) References Cited

U.S. PATENT DOCUMENTS 4,866,774 A * 9/1989 Klayman ..... H04S 1/002 381/1
5,046,098 A * 9/1991 Mandell ..... H04S 3/02 381/22
6,757,395 B1 * 6/2004 Fang ..... G10L 21/0208 381/94.3
6,920,223 B1 * 7/2005 Fosgate ..... H04S 3/02 381/19
7,970,144 B1 * 6/2011 Avendano ..... H04S 7/30 381/1
8,050,434 B1 * 11/2011 Kato ..... H04S 3/002 381/310
8,275,610 B2 9/2012 Faller et al.
8,577,676 B2 11/2013 Muesch
8,605,914 B2 * 12/2013 Neoran ..... H04S 5/00 381/1
8,891,778 B2 * 11/2014 Brown ..... G10L 21/0208 381/103
9,219,973 B2 * 12/2015 Muesch ..... G10L 21/0208
9,264,836 B2 * 2/2016 Katsianos ..... H03G 9/005
9,299,359 B2 * 3/2016 Taleb ..... G10L 21/02
9,451,378 B2 * 9/2016 Park ..... H04S 3/008
9,747,923 B2 * 8/2017 Salmela ..... G10L 21/034
9,794,715 B2 * 10/2017 Walsh ..... H04S 5/00
9,805,726 B2 * 10/2017 Adami ..... H04S 5/00
9,805,738 B2 * 10/2017 Krini ..... G10L 21/02
9,870,771 B2 * 1/2018 Zhou ..... G10L 15/20
2003/0055636 A1 * 3/2003 Katuo ..... G10L 21/0364 704/225
2004/0057586 A1 * 3/2004 Licht ..... H03G 3/32 381/94.7
2004/0125960 A1 * 7/2004 Fosgate ..... H04S 3/02 381/20
2006/0182284 A1 * 8/2006 Williams ..... H04S 1/002 381/17
2006/0198527 A1 * 9/2006 Chun ..... H04S 3/00 381/17
2007/0041592 A1 * 2/2007 Avendano ..... H04S 1/007 381/99
2007/0081597 A1 * 4/2007 Disch ..... G10L 19/008 375/242
2007/0208565 A1 9/2007 Lakaniemi et al.
2008/0037151 A1 * 2/2008 Fujimoto ..... G11B 20/10 360/18
2008/0165286 A1 7/2008 Oh et al.
2008/0187156 A1 * 8/2008 Yokota ..... H04R 1/025 381/307
2008/0205658 A1 * 8/2008 Breebaart ..... H04S 3/004 381/17
2008/0298597 A1 * 12/2008 Turku ..... H04S 5/00 381/27
2009/0046864 A1 * 2/2009 Mahabub ..... H04S 7/30 381/17
2009/0112579 A1 * 4/2009 Li ..... G10L 21/0208 704/205
2010/0076769 A1 * 3/2010 Yu ..... G10L 19/0204 704/269
2010/0100386 A1 * 4/2010 Yu ..... G10L 21/0208 704/270
2010/0189283 A1 7/2010 Sugai
2010/0226498 A1 * 9/2010 Kino ..... G11B 20/10527 381/1
2010/0296672 A1 * 11/2010 Vickers ..... H04H 60/04 381/119
2010/0303246 A1 * 12/2010 Walsh ..... H04S 3/00 381/18
2011/0119061 A1 * 5/2011 Brown ..... G10L 19/008 704/258
2011/0191101 A1 8/2011 Uhle et al.
2011/0274280 A1 * 11/2011 Brown ..... H04S 3/02 381/20
2012/0051569 A1 * 3/2012 Blamey ..... H04R 25/70 381/314
2012/0250895 A1 * 10/2012 Katsianos ..... H03G 9/005 381/107
2013/0006619 A1 1/2013 Muesch
2013/0282373 A1 * 10/2013 Visser ..... G10L 21/0208 704/233
2014/0044288 A1 * 2/2014 Kato ..... H04S 3/002 381/307
2014/0056435 A1 * 2/2014 Kjems ..... G10L 15/20 381/66
2014/0149111 A1 * 5/2014 Matsuo ..... G10L 21/0232 704/206
2014/0270185 A1 * 9/2014 Walsh ..... H04S 5/00 381/17
2016/0066087 A1 * 3/2016 Solbach ..... H04R 3/005 381/71.1
2016/0249151 A1 * 8/2016 Grosche ..... H04S 1/002
2017/0098456 A1 * 4/2017 Ma ..... G10L 21/0364
2018/0047412 A1 * 2/2018 Erkelens ..... G10L 25/12

FOREIGN PATENT DOCUMENTS

JP H10303666 A 11/1998
JP 2001238300 A 8/2001
JP 2005229544 A 8/2005
JP 2010518655 A 5/2010
JP 2012034295 A 2/2012
JP 2012169781 A 9/2012
RU 2381571 C2 2/2010
RU 2520420 C2 6/2014
WO 2009004718 A1 1/2009
WO WO 2009035615 A1 3/2009
WO 2014046941 A1 3/2014

OTHER PUBLICATIONS

Vickers, "Frequency-Domain Two-to Three Channel Upmix for center Channel Derivation and Speech Enhancement," pp. 1-24 (2009).
Fuchs et al., "Dialogue Enhancements—Technology and Experiment," EBU Technical Review, pp. 1-11 (2012).
Lopatka et al., "Novel 5.1 downmix algorithm with improved dialogue intelligibility," Convention Paper 8831, Rome, Italy, Audio Engineering Society (May 4-7, 2013).
Ephraim et al., "Speech Enhancement Using a Minimum Mean-Square Error Short-Time Spectral Amplitude Estimator," IEEE Transactions on Acoustics, Speech, and Signal Processing, vol. asp-32, No. 6, pp. 1109-1121, Institute of Electrical and Electronics Engineers, New York, New York (Dec. 1984).
Irwan et al., "Two-to-Five Channel Sound Processing," Papers, vol. 50, No. 11, pp. 914-926 Audio Engineering Society (Nov. 2002).
JP 2017-516852, Notice of Reasons for Rejection, dated Jun. 5, 2018.

(56) References Cited

OTHER PUBLICATIONS

RU 2017109646, Office Action and Search Report, dated May 25, 2018.

* cited by examiner

SIGNAL PROCESSING APPARATUS FOR ENHANCING A VOICE COMPONENT WITHIN A MULTI-CHANNEL AUDIO SIGNAL

CROSS-REFERENCE TO RELATED APPLICATIONS

This application is a continuation of International Application No. PCT/EP2014/077620, filed on Dec. 12, 2014, the disclosure of which is hereby incorporated by reference in its entirety.

TECHNICAL FIELD

The disclosure relates to the field of audio signal processing, in particular to voice enhancement within multi-channel audio signals.

BACKGROUND

For enhancing a voice component within multi-channel audio signals, e.g. entertainment audio signals, different approaches are currently employed.

A simple approach for enhancing the voice component is to boost a center channel audio signal comprised by the multi-channel audio signal, or accordingly to attenuate all audio signals of other channels. This approach exploits the assumption that voice is typically panned to the center channel audio signal. However, this approach usually suffers from a low performance of voice enhancement.

A more sophisticated approach tries to analyze the audio signals of the separate channels. In this regard, information about the relationship between the center channel audio signal and the audio signals of other channels can be provided together with a stereo down-mix in order to enable voice enhancement. However, this approach cannot be applied to stereo audio signals and requires a separate voice audio channel.

A further approach to improve a level of soft voice components and to attenuate loud non-voice components within the multi-channel audio signal is dynamic range compression (DRC). Firstly, this approach comprises attenuating loud components. Then, an overall loudness level is increased, which results in a voice or dialogue boost. However, this approach does not factor the nature of the multi-channel audio signal and the modification is only pertinent with regard to the loudness level.

SUMMARY

It is an object of the disclosure to provide an efficient concept for enhancing a voice component within a multi-channel audio signal.

This object is achieved by the features of the independent claims. Further implementation forms are apparent from the dependent claims, the description and the figures.

The disclosure is based on the finding that the multi-channel audio signal can be filtered upon the basis of a gain function, which can be determined from all channels of the multi-channel audio signal. The filtering can be based on a Wiener filtering approach, wherein a center channel audio signal of the multi-channel audio signal can be considered as comprising the voice component, and wherein further channels of the multi-channel audio signal can be considered as comprising non-voice components. In order to consider a variation of the voice component within the multi-channel audio signal over time, voice activity detection can further be performed, wherein all channels of the multi-channel audio signal can be processed in order to provide a voice activity indicator. The multi-channel audio signal can be a result of a stereo up-mixing process of an input stereo audio signal. Consequently, an efficient enhancement of the voice component within the multi-channel audio signal can be realized.

According to a first aspect, the disclosure relates to a signal processing apparatus for enhancing a voice component within a multi-channel audio signal, the multi-channel audio signal comprising a left channel audio signal, a center channel audio signal, and a right channel audio signal, the signal processing apparatus comprising a filter and a combiner, wherein the filter is configured to determine a measure representing an overall magnitude of the multi-channel audio signal over frequency upon the basis of the left channel audio signal, the center channel audio signal, and the right channel audio signal, to obtain a gain function based on a ratio between a measure of magnitude of the center channel audio signal and the measure representing the overall magnitude of the multi-channel audio signal, and to weight the left channel audio signal by the gain function to obtain a weighted left channel audio signal, to weight the center channel audio signal by the gain function to obtain a weighted center channel audio signal, and to weight the right channel audio signal by the gain function to obtain a weighted right channel audio signal, and wherein the combiner is configured to combine the left channel audio signal with the weighted left channel audio signal to obtain a combined left channel audio signal, to combine the center channel audio signal with the weighted center channel audio signal to obtain a combined center channel audio signal, and to combine the right channel audio signal with the weighted right channel audio signal to obtain a combined right channel audio signal. Thus, an efficient concept for enhancing a voice component within a multi-channel audio signal is realized.

The multi-channel audio signal comprises the left channel audio signal, the center channel audio signal, and the right channel audio signal. The multi-channel audio signal can further comprise a left surround channel audio signal and a right surround channel audio signal. The multi-channel audio signal can be an LCR/3.0 stereo audio signal or 5.1 surround audio signal. Determining the measure representing the overall magnitude of the multi-channel audio signal over frequency comprises determining the measure representing the overall magnitude of the multi-channel audio signal in frequency domain.

The gain function can indicate a ratio of a magnitude of the voice component and the overall magnitude of the multi-channel audio signal, wherein it is assumed that the voice component is comprised by the center channel audio signal. The overall magnitude of the multi-channel audio signal can be determined using an addition of the voice component and non-voice components within the multi-channel audio signal over frequency. The gain function can be frequency dependent.

In a first implementation form of the signal processing apparatus according to the first aspect as such, the filter is configured to determine the measure representing the overall magnitude of the multi-channel audio signal as the sum of the measure of magnitude of the center channel audio signal and a measure of magnitude of a difference of the left channel audio signal and the right channel audio signal. Thus, the measure representing the overall magnitude of the multi-channel audio signal is determined efficiently and in a more suitable way to be used for obtaining the filter gain function, because the difference of the left channel audio signal and the right channel audio signal represents a residual signal which does not contain components of the center channel audio signal.

In a second implementation form of the signal processing apparatus according to the first aspect as such or any preceding implementation form of the first aspect, the filter is configured to determine the gain function according to the following equations:

$$G(m,k) = \frac{P_C(m,k)}{P_C(m,k) + P_S(m,k)}$$

$$P_C(m,k) = |C(m,k)|^2$$

$$P_S(m,k) = |L(m,k) - R(m,k)|^2$$

wherein G denotes the gain function, L denotes the left channel audio signal, C denotes the center channel audio signal, R denotes the right channel audio signal, $P_C$ denotes a power of the center channel audio signal as the measure representing a magnitude of the center channel audio signal, $P_S$ denotes a power of a difference between the left channel audio signal and the right channel audio signal, and the sum of $P_C$ and $P_S$ denotes the measure representing the overall magnitude of the multi-channel audio signal, m denotes a sample time index, and k denotes a frequency bin index. Thus, the gain function is determined in an efficient and powerful manner.

The gain function is determined according to a Wiener filtering approach. The center channel audio signal is regarded as to comprise the voice component. The difference between the left channel audio signal and the right channel audio signal is regarded as to comprise the non-voice component, based in the assumption that voice components are panned to the center channel audio signal. By defining the components of the Wiener filter in this way, it is avoided to employ expensive methods for estimating the signal-to-noise-ratio or the noise power spectral density of the signal.

Instead of using a power within the equations, a magnitude or logarithmic power can be employed for determining the gain function. The difference between the left channel audio signal and the right channel audio signal can refer to a residual audio signal comprising a combination of non-center channel audio signals, wherein all audio signals except the center channel audio signal may also be referred to as non-center channel audio signals. The residual audio signal can be the difference between the left channel audio signal and the right channel audio signal.

A sum of the magnitude of the left channel audio signal and the right channel audio corresponds to a beam-forming being a specific form of center channel extraction, and may also be used in embodiments of the disclosure. However, a difference of the magnitude of the left channel audio signal and the right channel audio corresponds to a removal of a component of the center channel. Thus, the residual audio signal defined as the difference between the left channel audio signal and the right channel audio signal results in an improved estimation of the filter gain.

In a third implementation form of the signal processing apparatus according to the first aspect as such or any preceding implementation form of the first aspect, the multi-channel audio signal further comprises a left surround channel audio signal and a right surround channel audio signal, wherein the filter is configured to determine the measure representing the overall magnitude of the multi-channel audio signal over frequency additionally upon the basis of the left surround channel audio signal and the right surround channel audio signal, and to determine the measure representing the overall magnitude of the multi-channel audio signal as the sum of the measure of magnitude of the center channel audio signal, of a measure of magnitude of a difference of the left channel audio signal and the right channel audio signal, and of a measure of magnitude of a difference of the left surround channel audio signal and the right surround channel audio signal. Thus, surround channels within the multi-channel audio signal are processed efficiently, by obtaining the magnitude from the difference of the left surround channel audio signal and the right surround channel audio signal. The difference signal gives a better distinction to the center channel audio signal.

In a fourth implementation form of the signal processing apparatus according to the first aspect as such or any preceding implementation form of the first aspect, the filter is configured to weight frequency bins of the left channel audio signal by frequency bins of the gain function to obtain frequency bins of the weighted left channel audio signal, to weight frequency bins of the center channel audio signal by frequency bins of the gain function to obtain frequency bins of the weighted center channel audio signal, and to weight frequency bins of the right channel audio signal by frequency bins of the gain function to obtain frequency bins of the weighted right channel audio signal. Thus, the multi-channel audio signal is processed efficiently in the frequency domain. Weighting all signals with the same filter has the advantage that no shifting of audio source locations in the stereo image occurs. Furthermore, in this way, the voice component is extracted from all signals.

The filter can further be configured to group the frequency bins according to a Mel frequency scale to obtain frequency bands. The index k can consequently correspond to a frequency band index. The filter can further be configured to only process frequency bins or frequency bands arranged within a predetermined frequency range, e.g. 100 Hz to 8 kHz. In this way, only frequencies comprising human voice are processed.

In a fifth implementation form of the signal processing apparatus according to the first aspect as such or any preceding implementation form of the first aspect, the signal processing apparatus further comprises a voice activity detector being configured to determine a voice activity indicator upon the basis of the left channel audio signal, the center channel audio signal, and the right channel audio signal, the voice activity indicator indicating a magnitude of the voice component within the multi-channel audio signal over time, wherein the combiner is further configured to combine the weighted left channel audio signal with the voice activity indicator to obtain the combined left channel audio signal, to combine the weighted center channel audio signal with the voice activity indicator to obtain the combined center channel audio signal, and to combine the weighted right channel audio signal with the voice activity indicator to obtain the combined right channel audio signal. Thus, an efficient enhancement of a time-varying voice component within the multi-channel audio signal is realized, and non-speech signals are suppressed.

The voice activity indicator indicates the magnitude of the voice component within the multi-channel audio signal in time domain. The voice activity indicator is, for example, equal to zero when no voice component is present in the signal, and equal to one when voice is present. Values between zero and one can be interpreted as a probability of voice being present, and help to obtain a smooth output signal.

In a sixth implementation form of the signal processing apparatus according to the fifth implementation form of the first aspect, the voice activity detector is configured to determine a measure representing an overall spectral variation of the multi-channel audio signal upon the basis of the left channel audio signal, the center channel audio signal, and the right channel audio signal, and to obtain the voice activity indicator based on a ratio between a measure of spectral variation of the center channel audio signal and the measure representing the overall spectral variation of the multi-channel audio signal. Thus, the voice activity indicator is determined efficiently by exploiting a relationship between the measures of spectral variation.

The measure representing the overall spectral variation can be a spectral flux or a temporal derivative. The spectral flux can be determined using different approaches for normalization. The spectral flux can be computed as a difference of power spectra between two or more audio signal frames. The measure representing the overall spectral variation can be the sum of $F_C$ and $F_S$, wherein $F_C$ denotes the measure of spectral variation of the center channel audio signal, and wherein $F_S$ denotes a measure of spectral variation of a difference between the left channel audio signal and the right channel audio signal.

In a seventh implementation form of the signal processing apparatus according to the sixth implementation form of the first aspect, the voice activity detector is configured to determine the voice activity indicator according to the following equation:

$$V = a \times \left(\frac{F_c}{F_c + F_s} - 0.5\right)$$

wherein V denotes the voice activity indicator, $F_C$ denotes the measure of spectral variation of the center channel audio signal, $F_S$ denotes a measure of spectral variation of a difference between the left channel audio signal and the right channel audio signal, and the sum of $F_C$ and $F_S$ denotes the measure representing the overall spectral variation of the multi-channel audio signal, and a denotes a predetermined scaling factor. Thus, the voice activity indicator is determined efficiently. Signals with the same values of $F_C$ and $F_S$ result in a voice activity indicator with a value of zero. Higher values of $F_C$ lead to higher values of the voice activity indicator. The scaling factor a can control the magnitude of the voice activity indicator.

The values of the voice activity indicator can be independent of a prior normalization of the measures. The values of the voice activity indicator can be limited to the interval [0; 1].

In an eighth implementation form of the signal processing apparatus according to the seventh implementation form of the first aspect, the voice activity detector is configured to determine the measure of spectral variation of the center channel audio signal as the spectral flux and the measure of spectral variation of the difference between the left channel audio signal and the right channel audio signal as the spectral flux according to the following equations:

$$F_C(m) = \sum_k (|C(m, k)| - |C(m-1, k)|)^2$$

-continued $$F_S(m) = \sum_k (|S(m, k)| - |S(m-1, k)|)^2$$

wherein $F_C$ denotes the spectral flux of the center channel audio signal, $F_S$ denotes the spectral flux of the difference between the left channel audio signal and the right channel audio signal, C denotes the center channel audio signal, S denotes the difference between the left channel audio signal and the right channel audio signal, m denotes a sample time index, and k denotes a frequency bin index. Thus, the spectral flux is determined efficiently.

In a ninth implementation form of the signal processing apparatus according to the fifth implementation form to the eighth implementation form of the first aspect, the voice activity detector is configured to filter the voice activity indicator in time upon the basis of a predetermined low-pass filtering function. Thus, an efficient mitigation of artifacts within the multi-channel audio signal and/or an efficient temporal smoothing of the voice activity indicator are realized.

The predetermined low-pass filtering function can be realized by a one-tap finite impulse response (FIR) low-pass filter.

In a tenth implementation form of the signal processing apparatus according to the fifth implementation form to the ninth implementation form of the first aspect, the combiner is further configured to weight the left channel audio signal, the center channel audio signal, and the right channel audio signal by a predetermined input gain factor, and to weight the voice activity indicator by a predetermined speech gain factor. Thus, an efficient control of the magnitude of the voice component with regard to the magnitude of a non-voice component is realized.

In an eleventh implementation form of the signal processing apparatus according to the fifth implementation form to the tenth implementation form of the first aspect, the combiner is configured to add the left channel audio signal to the combination of the weighted left channel audio signal with the voice activity indicator to obtain the combined left channel audio signal, to add the center channel audio signal to the combination of the weighted left channel audio signal with the voice activity indicator to obtain the combined center channel audio signal, and to add the right channel audio signal to the combination of the weighted left channel audio signal with the voice activity indicator to obtain the combined right channel audio signal. Thus, the combiner is implemented efficiently. The extracted voice components are combined with the original signals to enhance the voice component in the output signals.

In a twelfth implementation form of the signal processing apparatus according to the fifth implementation form to the eleventh implementation form of the first aspect, the multi-channel audio signal further comprises a left surround channel audio signal and a right surround channel audio signal, wherein the voice activity detector is configured to determine the voice activity indicator additionally upon the basis of the left surround channel audio signal and the right surround channel audio signal. Thus, surround channels within the multi-channel audio signal are also taken into account for determining the voice activity indicator, resulting in a better estimation of the voice activity indicator.

In a thirteenth implementation form of the signal processing apparatus according to the first aspect as such or any preceding implementation form of the first aspect, the signal processing apparatus further comprises a transformer being configured to transform the left channel audio signal, the center channel audio signal, and the right channel audio signal from time domain into frequency domain. Thus, an efficient transformation of the audio signals into frequency domain is realized. This may be required in the case that the speech enhancement and voice activity detection are carried out in the frequency domain.

The transformer can be configured to perform a short-time discrete Fourier transform (STFT) of the left channel audio signal, the center channel audio signal, and the right channel audio signal.

In a fourteenth implementation form of the signal processing apparatus according to the first aspect as such or any preceding implementation form of the first aspect, the signal processing apparatus further comprises an inverse transformer being configured to inversely transform the combined left channel audio signal, the combined center channel audio signal, and the combined right channel audio signal from frequency domain into time domain. Thus, an efficient inverse transformation of the audio signals into time domain is realized, and output signals in time domain are obtained.

The inverse transformer can be configured to perform an inverse short-time discrete Fourier transform (ISTFT) of the combined left channel audio signal, the combined center channel audio signal, and the combined right channel audio signal.

In a fifteenth implementation form of the signal processing apparatus according to the first aspect as such or any preceding implementation form of the first aspect, the signal processing apparatus further comprises an up-mixer being configured to determine the left channel audio signal, the center channel audio signal, and the right channel audio signal upon the basis of an input left channel stereo audio signal and an input right channel stereo audio signal. In this way, the signal processing apparatus can be applied for processing a two-channel, i.e. left and right channel, input stereo audio signal.

In a sixteenth implementation form of the signal processing apparatus according to the fifteenth implementation form of the first aspect, the up-mixer is configured to determine the left channel audio signal, the center channel audio signal, and the right channel audio signal according to the following equations:

$$C = \alpha \times (L_{in} + R_{in})$$

$$L = L_{in} - C$$

$$R = R_{in} - C$$

$$\alpha = \frac{1}{2} \times \left(1 - \sqrt{\frac{(L_r - R_r)^2 + (L_i - R_i)^2}{(L_r + R_r)^2 + (L_i + R_i)^2}}\right)$$

wherein $L_r$ denotes a real part of the input left channel stereo audio signal, $R_r$ denotes a real part of the input right channel stereo audio signal, $L_i$ denotes an imaginary part of the input left channel stereo audio signal, $R_i$ denotes an imaginary part of the input right channel stereo audio signal, $\alpha$ denotes an orthogonality parameter, $L_{in}$ denotes the input left channel stereo audio signal, $R_{in}$ denotes the input right channel stereo audio signal, L denotes the left channel audio signal, C denotes the center channel audio signal, and R denotes the right channel audio signal. Thus, an efficient center channel extraction of the input stereo audio signal is realized using an orthogonal decomposition. The resulting left channel audio signal and right channel audio signal are orthogonal to each other.

In a seventeenth implementation form of the signal processing apparatus according to the first aspect as such or any preceding implementation form of the first aspect, the signal processing apparatus further comprises a down-mixer being configured to determine an output left channel stereo audio signal and an output right channel stereo audio signal upon the basis of the combined left channel audio signal, the combined center channel audio signal, and the combined right channel audio signal. Thus, a two-channel, i.e. left and right channel, output stereo audio signal is provided efficiently.

In an eighteenth implementation form of the signal processing apparatus according to the first aspect as such or any preceding implementation form of the first aspect, the measure of magnitude comprises a power, a logarithmic power, a magnitude or a logarithmic magnitude of a signal. Thus, the measure of magnitude can indicate different values at different scales.

The magnitude of the multi-channel audio signal comprises a power, a logarithmic power, a magnitude or a logarithmic magnitude of the multi-channel audio signal. The measure of magnitude of the difference of the left channel audio signal and the right channel audio signal comprises a power, a logarithmic power, a magnitude or a logarithmic magnitude of the difference of the left channel audio signal and the right channel audio signal. The magnitude of the center channel audio signal comprises a power, a logarithmic power, a magnitude or a logarithmic magnitude of the center channel audio signal. The signal can refer to any signal processed by the signal processing apparatus.

In a nineteenth implementation form of the signal processing apparatus according to the first aspect as such or any preceding implementation form of the first aspect, the combiner is further configured to weight the left channel audio signal, the center channel audio signal, and the right channel audio signal by a predetermined input gain factor, and to weight the weighted left channel audio signal, the weighted center channel audio signal, and the weighted right channel audio signal by a predetermined speech gain factor. Thus, an efficient control of the magnitude of the voice component with regard to the magnitude of a non-voice component is realized.

The weighted audio signals $C_E$, $L_E$, and $R_E$, can be weighted by the predetermined speech gain factor $G_S$. The weighting can be performed without using the voice activity detector.

According to a second aspect, the disclosure relates to a signal processing method for enhancing a voice component within a multi-channel audio signal, the multi-channel audio signal comprising a left channel audio signal, a center channel audio signal, and a right channel audio signal, the signal processing method comprising determining, by a filter, a measure representing an overall magnitude of the multi-channel audio signal over frequency upon the basis of the left channel audio signal, the center channel audio signal, and the right channel audio signal, obtaining, by the filter, a gain function based on a ratio between a measure of magnitude of the center channel audio signal and the measure representing the overall magnitude of the multi-channel audio signal, weighting, by the filter, the left channel audio signal by the gain function to obtain a weighted left channel audio signal, weighting, by the filter, the center channel audio signal by the gain function to obtain a weighted center channel audio signal, weighting, by the filter, the right channel audio signal by the gain function to obtain a weighted right channel audio signal, combining, by a combiner, the left channel audio signal with the weighted left channel audio signal to obtain a combined left channel audio signal, combining, by the combiner, the center channel audio signal with the weighted center channel audio signal to obtain a combined center channel audio signal, and combining, by the combiner, the right channel audio signal with the weighted right channel audio signal to obtain a combined right channel audio signal. Thus, an efficient concept for enhancing a voice component within a multi-channel audio signal is realized.

The signal processing method can be performed by the signal processing apparatus. Further features of the signal processing method directly result from the functionality of the signal processing apparatus.

In a first implementation form of the signal processing method according to the second aspect as such, the method comprises determining, by the filter, the measure representing the overall magnitude of the multi-channel audio signal as the sum of the measure of magnitude of the center channel audio signal and a measure of magnitude of a difference of the left channel audio signal and the right channel audio signal. Thus, the measure representing the overall magnitude of the multi-channel audio signal is determined efficiently and in a more suitable way to be used for obtaining the filter gain function, because the difference of the left channel audio signal and the right channel audio signal represents a residual signal which does not contain components of the center channel audio signal.

In a second implementation form of the signal processing method according to the second aspect as such or any preceding implementation form of the second aspect, the method comprises determining, by the filter, the gain function according to the following equations:

$$G(m,k) = \frac{P_C(m,k)}{P_C(m,k) + P_S(m,k)}$$

$$P_C(m,k) = |C(m,k)|^2$$

$$P_S(m,k) = |L(m,k) - R(m,k)|^2$$

wherein G denotes the gain function, L denotes the left channel audio signal, C denotes the center channel audio signal, R denotes the right channel audio signal, $P_C$ denotes a power of the center channel audio signal as the measure representing a magnitude of the center channel audio signal, $P_S$ denotes a power of a difference between the left channel audio signal and the right channel audio signal, and the sum of $P_C$ and $P_S$ denotes the measure representing the overall magnitude of the multi-channel audio signal, m denotes a sample time index, and k denotes a frequency bin index. Thus, the gain function is determined in an efficient and powerful manner.

In a third implementation form of the signal processing method according to the second aspect as such or any preceding implementation form of the second aspect, the multi-channel audio signal further comprises a left surround channel audio signal and a right surround channel audio signal, wherein the method comprises determining, by the filter, the measure representing the overall magnitude of the multi-channel audio signal over frequency additionally upon the basis of the left surround channel audio signal and the right surround channel audio signal, and determining, by the filter, the measure representing the overall magnitude of the multi-channel audio signal as the sum of the measure of magnitude of the center channel audio signal, of a measure of magnitude of a difference of the left channel audio signal and the right channel audio signal, and of a measure of magnitude of a difference of the left surround channel audio signal and the right surround channel audio signal. Thus, surround channels within the multi-channel audio signal are processed efficiently, by obtaining the magnitude from the difference of the left surround channel audio signal and the right surround channel audio signal. The difference signal gives a better distinction to the center channel audio signal.

In a fourth implementation form of the signal processing method according to the second aspect as such or any preceding implementation form of the second aspect, the method comprises weighting, by the filter, frequency bins of the left channel audio signal by frequency bins of the gain function to obtain frequency bins of the weighted left channel audio signal, weighting, by the filter, frequency bins of the center channel audio signal by frequency bins of the gain function to obtain frequency bins of the weighted center channel audio signal, and weighting, by the filter, frequency bins of the right channel audio signal by frequency bins of the gain function to obtain frequency bins of the weighted right channel audio signal. Thus, the multi-channel audio signal is processed efficiently in the frequency domain. Weighting all signals with the same filter has the advantage that no shifting of audio source locations in the stereo image occurs. Furthermore, in this way, the voice component is extracted from all signals.

In a fifth implementation form of the signal processing method according to the second aspect as such or any preceding implementation form of the second aspect, the method comprises determining, by a voice activity detector, a voice activity indicator upon the basis of the left channel audio signal, the center channel audio signal, and the right channel audio signal, the voice activity indicator indicating a magnitude of the voice component within the multi-channel audio signal over time, combining, by the combiner, the weighted left channel audio signal with the voice activity indicator to obtain the combined left channel audio signal, combining, by the combiner, the weighted center channel audio signal with the voice activity indicator to obtain the combined center channel audio signal, and combining, by the combiner, the weighted right channel audio signal with the voice activity indicator to obtain the combined right channel audio signal. Thus, an efficient enhancement of a time-varying voice component within the multi-channel audio signal is realized, and non-speech signals are suppressed.

In a sixth implementation form of the signal processing method according to the fifth implementation form of the second aspect, the method comprises determining, by the voice activity detector, a measure representing an overall spectral variation of the multi-channel audio signal upon the basis of the left channel audio signal, the center channel audio signal, and the right channel audio signal, and obtaining, by the voice activity detector, the voice activity indicator based on a ratio between a measure of spectral variation of the center channel audio signal and the measure representing the overall spectral variation of the multi-channel audio signal. Thus, the voice activity indicator is determined efficiently by exploiting the relationship between the measures of spectral variation.

In a seventh implementation form of the signal processing method according to the sixth implementation form of the second aspect, the method comprises determining, by the voice activity detector, the voice activity indicator according to the following equation:

$$V = a \times \left(\frac{F_c}{F_c + F_s} - 0.5\right)$$

wherein V denotes the voice activity indicator, $F_C$ denotes the measure of spectral variation of the center channel audio signal, $F_S$ denotes a measure of spectral variation of a difference between the left channel audio signal and the right channel audio signal, and the sum of $F_C$ and $F_S$ denotes the measure representing the overall spectral variation of the multi-channel audio signal, and a denotes a predetermined scaling factor. Thus, the voice activity indicator is determined efficiently. Signals with the same values of $F_C$ and $F_S$ result in a voice activity indicator with a value of zero. Higher values of $F_C$ lead to higher values of the voice activity indicator. The scaling factor a can control the magnitude of the voice activity indicator.

In an eighth implementation form of the signal processing method according to the seventh implementation form of the second aspect, the method comprises determining, by the voice activity detector, the measure of spectral variation of the center channel audio signal as the spectral flux and the measure of spectral variation of the difference between the left channel audio signal and the right channel audio signal as the spectral flux according to the following equations:

$$F_C(m) = \sum_k (|C(m, k)| - |C(m-1, k)|)^2$$

$$F_S(m) = \sum_k (|S(m, k)| - |S(m-1, k)|)^2$$

wherein $F_C$ denotes the spectral flux of the center channel audio signal, $F_S$ denotes the spectral flux of the difference between the left channel audio signal and the right channel audio signal, C denotes the center channel audio signal, S denotes the difference between the left channel audio signal and the right channel audio signal, m denotes a sample time index, and k denotes a frequency bin index. Thus, the spectral flux is determined efficiently.

In a ninth implementation form of the signal processing method according to the fifth implementation form to the eighth implementation form of the second aspect, the method comprises filtering, by the voice activity detector, the voice activity indicator in time upon the basis of a predetermined low-pass filtering function. Thus, an efficient mitigation of artifacts within the multi-channel audio signal and/or an efficient temporal smoothing of the voice activity indicator are realized.

In a tenth implementation form of the signal processing method according to the fifth implementation form to the ninth implementation form of the second aspect, the method comprises weighting, by the combiner, the left channel audio signal, the center channel audio signal, and the right channel audio signal by a predetermined input gain factor, and weighting, by the combiner, the voice activity indicator by a predetermined speech gain factor. Thus, an efficient control of the magnitude of the voice component with regard to the magnitude of a non-voice component is realized.

In an eleventh implementation form of the signal processing method according to the fifth implementation form to the tenth implementation form of the second aspect, the method comprises adding, by the combiner, the left channel audio signal to the combination of the weighted left channel audio signal with the voice activity indicator to obtain the combined left channel audio signal, adding, by the combiner, the center channel audio signal to the combination of the weighted left channel audio signal with the voice activity indicator to obtain the combined center channel audio signal, and adding, by the combiner, the right channel audio signal to the combination of the weighted left channel audio signal with the voice activity indicator to obtain the combined right channel audio signal. Thus, combining is performed efficiently. The extracted voice components are combined with the original signals to enhance the voice component in the output signals.

In a twelfth implementation form of the signal processing method according to the fifth implementation form to the eleventh implementation form of the second aspect, the multi-channel audio signal further comprises a left surround channel audio signal and a right surround channel audio signal, wherein the method comprises determining, by the voice activity detector, the voice activity indicator additionally upon the basis of the left surround channel audio signal and the right surround channel audio signal. Thus, surround channels within the multi-channel audio signal are also taken into account for determining the voice activity indicator, resulting in a better estimation of the voice activity indicator.

In a thirteenth implementation form of the signal processing method according to the second aspect as such or any preceding implementation form of the second aspect, the method comprises transforming, by a transformer, the left channel audio signal, the center channel audio signal, and the right channel audio signal from time domain into frequency domain. Thus, an efficient transformation of the audio signals into frequency domain is realized. This is required, for example, if the speech enhancement and voice activity detection are carried out in the frequency domain.

In a fourteenth implementation form of the signal processing method according to the second aspect as such or any preceding implementation form of the second aspect, the method comprises inversely transforming, by an inverse transformer, the combined left channel audio signal, the combined center channel audio signal, and the combined right channel audio signal from frequency domain into time domain. Thus, an efficient inverse transformation of the audio signals into time domain is realized, and output signals in time domain are obtained.

In a fifteenth implementation form of the signal processing method according to the second aspect as such or any preceding implementation form of the second aspect, the method comprises determining, by an up-mixer, the left channel audio signal, the center channel audio signal, and the right channel audio signal upon the basis of an input left channel stereo audio signal and an input right channel stereo audio signal. In this way, the signal processing method can be applied for processing an input stereo audio signal.

In a sixteenth implementation form of the signal processing method according to the fifteenth implementation form of the second aspect, the method comprises determining, by the up-mixer, the left channel audio signal, the center channel audio signal, and the right channel audio signal according to the following equations:

$$C = \alpha \times (L_{in} + R_{in})$$

$$L = L_{in} - C$$

$$R = R_{in} - C$$

$$\alpha = \frac{1}{2} \times \left(1 - \sqrt{\frac{(L_r - R_r)^2 + (L_i - R_i)^2}{(L_r + R_r)^2 + (L_i + R_i)^2}}\right)$$

wherein $L_r$ denotes a real part of the input left channel stereo audio signal, $R_r$ denotes a real part of the input right channel stereo audio signal, $L_i$ denotes an imaginary part of the input left channel stereo audio signal, $R_i$ denotes an imaginary part of the input right channel stereo audio signal, $\alpha$ denotes an orthogonality parameter, $L_{in}$ denotes the input left channel stereo audio signal, $R_{in}$ denotes the input right channel stereo audio signal, L denotes the left channel audio signal, C denotes the center channel audio signal, and R denotes the right channel audio signal. Thus, an efficient center channel extraction of the input stereo audio signal is realized using an orthogonal decomposition. The resulting left channel audio signal and right channel audio signal are orthogonal to each other.

In a seventeenth implementation form of the signal processing method according to the second aspect as such or any preceding implementation form of the second aspect, the method comprises determining, by a down-mixer, an output left channel stereo audio signal and an output right channel stereo audio signal upon the basis of the combined left channel audio signal, the combined center channel audio signal, and the combined right channel audio signal. Thus, a two-channel, i.e. left and right channel, output stereo audio signal is provided efficiently.

In an eighteenth implementation form of the signal processing method according to the second aspect as such or any preceding implementation form of the second aspect, the measure of magnitude comprises a power, a logarithmic power, a magnitude or a logarithmic magnitude of a signal. Thus, the measure of magnitude can indicate different values at different scales.

In a nineteenth implementation form of the signal processing method according to the second aspect as such or any preceding implementation form of the second aspect, the method comprises weighting, by the combiner, the left channel audio signal, the center channel audio signal, and the right channel audio signal by a predetermined input gain factor, and weighting, by the combiner, the weighted left channel audio signal, the weighted center channel audio signal, and the weighted right channel audio signal by a predetermined speech gain factor. Thus, an efficient control of the magnitude of the voice component with regard to the magnitude of a non-voice component is realized.

According to a third aspect, the disclosure relates to a computer program comprising a program code for performing the method according to the second aspect as such or any of the implementation forms of the second aspect when executed on a computer. Thus, the method can be performed automatically.

The signal processing apparatus can be programmably arranged to execute the computer program and/or the program code.

The disclosure can be implemented in hardware and/or software.

BRIEF DESCRIPTION OF DRAWINGS

Embodiments of the disclosure will be described with respect to the following figures, in which.

The same reference signs are used for identical or equivalent features.

DETAILED DESCRIPTION OF EMBODIMENTS

Figure 1:
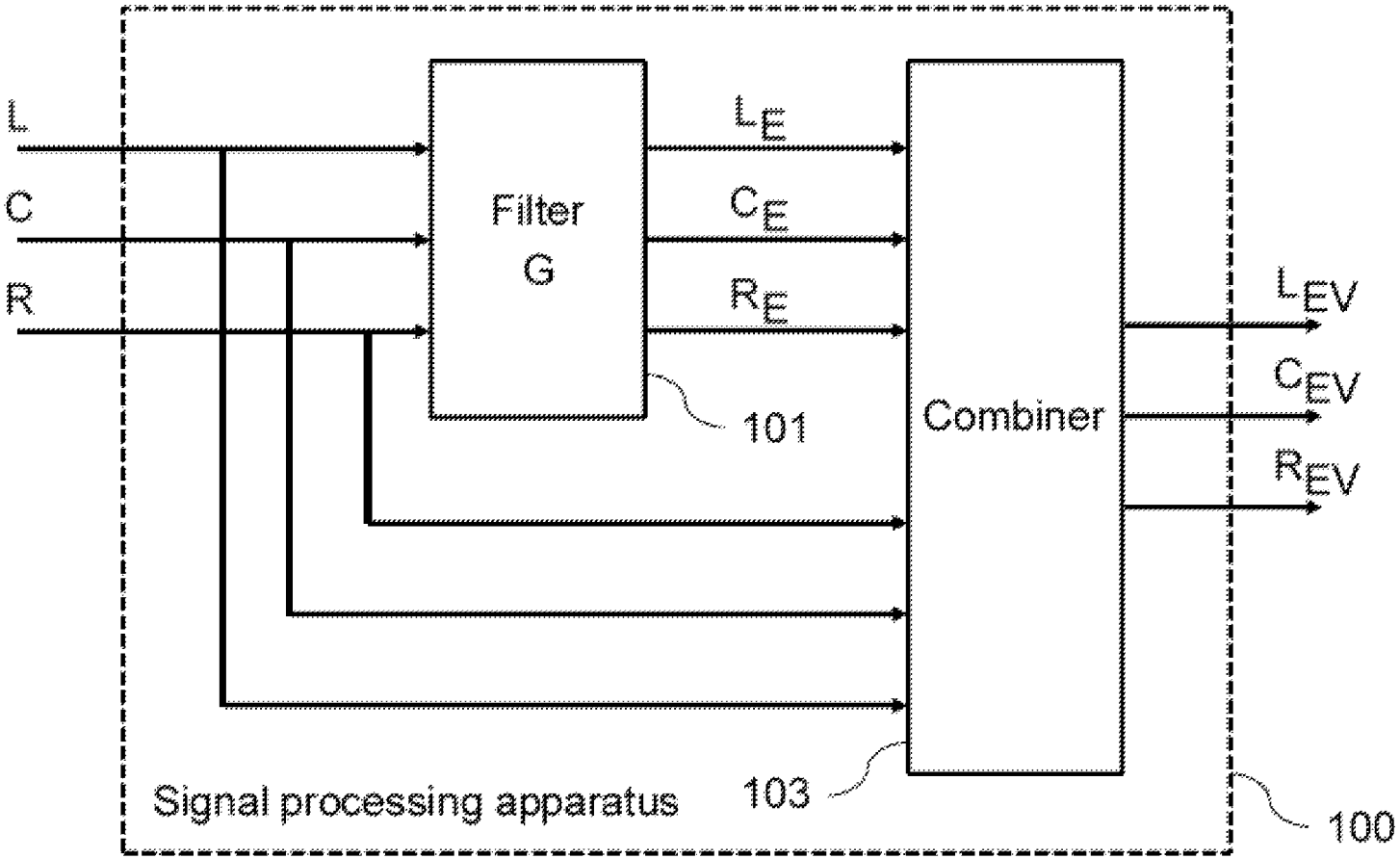
FIG. 1 shows a diagram of a signal processing apparatus for enhancing a voice component within a multi-channel audio signal according to an embodiment.

FIG. 1 shows a diagram of a signal processing apparatus 100 for enhancing a voice component within a multi-channel audio signal according to an embodiment. The multi-channel audio signal comprises a left channel audio signal L, a center channel audio signal C, and a right channel audio signal R. The signal processing apparatus 100 comprises a filter 101 and a combiner 103.

The filter 101 is configured to determine a measure representing an overall magnitude of the multi-channel audio signal over frequency upon the basis of the left channel audio signal L, the center channel audio signal C, and the right channel audio signal R, to obtain a gain function G based on a ratio between a measure of magnitude of the center channel audio signal C and the measure representing the overall magnitude of the multi-channel audio signal, and to weight the left channel audio signal L by the gain function G to obtain a weighted left channel audio signal $L_E$, to weight the center channel audio signal C by the gain function G to obtain a weighted center channel audio signal $C_E$, and to weight the right channel audio signal R by the gain function G to obtain a weighted right channel audio signal $R_E$.

The combiner 103 is configured to combine the left channel audio signal L with the weighted left channel audio signal $L_E$ to obtain a combined left channel audio signal $L_{EV}$, to combine the center channel audio signal C with the weighted center channel audio signal $C_E$ to obtain a combined center channel audio signal $C_{EV}$, and to combine the right channel audio signal R with the weighted right channel audio signal $R_E$ to obtain a combined right channel audio signal $R_{EV}$.

The multi-channel audio signals may comprise, for example 3-channel stereo audio signals, which comprise only a left channel audio signal L, a right channel audio signal and a center channel audio signal C, and which may also be referred to as LCR stereo or 3.0 stereo audio signals, 5.1 multi-channel audio signals, which comprise a left channel audio signal L, a right channel audio signal R, a center channel audio signal C, a left surround channel audio signal $L_S$, a right surround channel audio signal $R_S$, and a bass channel signal B, or other multi-channel signals which have a center channel audio signal and at least two other channel audio signals. The audio signals other than the center channel audio signal C, e.g. the left channel audio signal L, the right channel audio signal R, the left surround channel audio signal $L_S$, the right surround channel audio signal $R_S$ and the bass channel signal B, may also be referred to as non-center channel audio signals. In the case of a 5.1 multi-channel audio signal, the measure representing an overall magnitude of the multi-channel audio signal can be obtained as the sum of the measure of magnitude of the center-channel audio signal, the measure of magnitude of the difference of the left channel audio signal and the right channel audio signal, the measure of magnitude of the difference of the left surround channel audio signal and the right surround channel audio signal, and the measure of magnitude of the low-frequency effects channel audio signal. In the case of a 5.1 multi-channel audio signal, the obtained filter can be used to weight all of the comprised audio signals.

Figure 2:
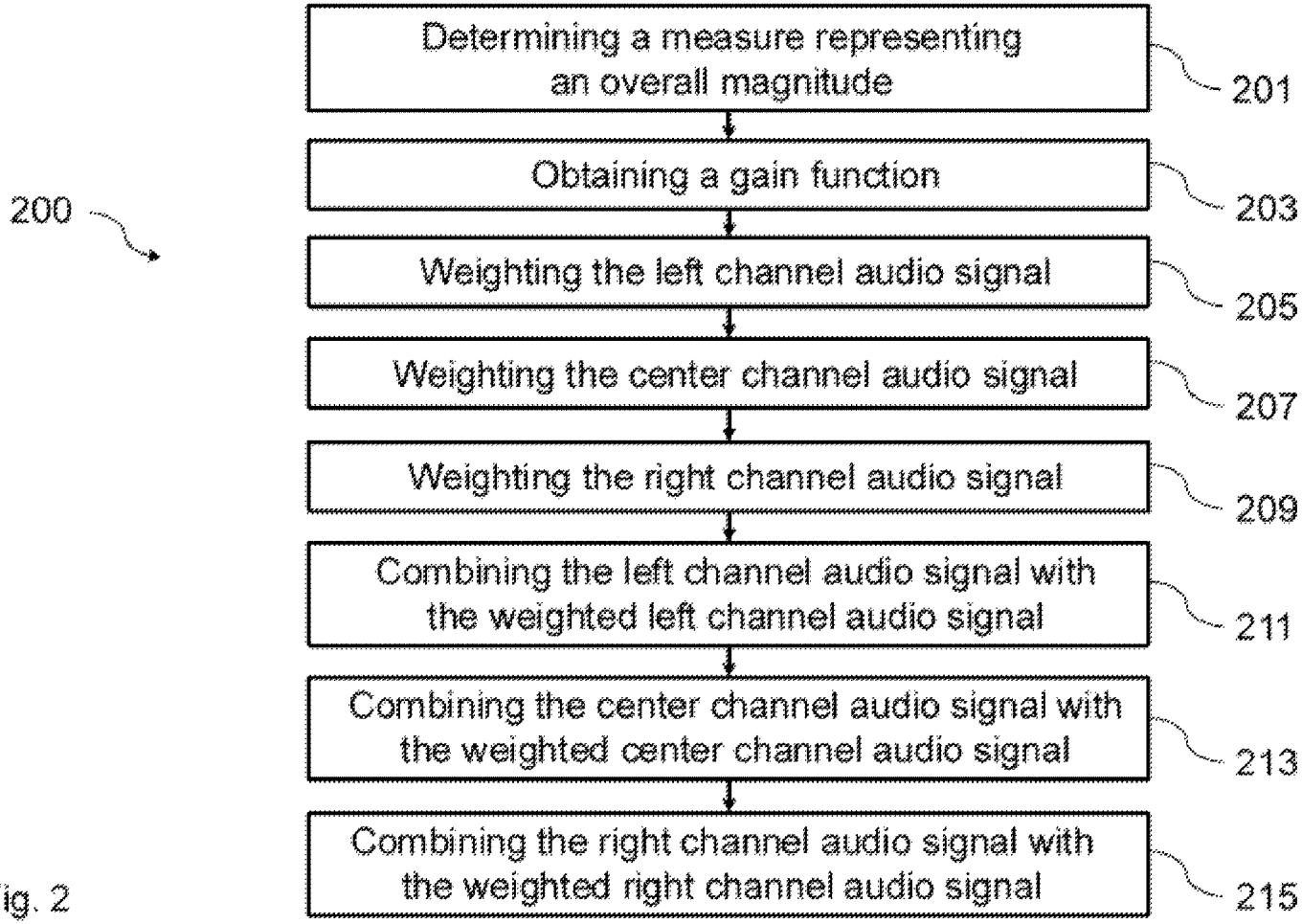
FIG. 2 shows a diagram of a signal processing method for enhancing a voice component within a multi-channel audio signal according to an embodiment.

FIG. 2 shows a diagram of a signal processing method 200 for enhancing a voice component within a multi-channel audio signal according to an embodiment. The multi-channel audio signal comprises a left channel audio signal L, a center channel audio signal C, and a right channel audio signal R.

The signal processing method 200 comprises determining 201 a measure representing an overall magnitude of the multi-channel audio signal over frequency upon the basis of the left channel audio signal L, the center channel audio signal C, and the right channel audio signal R, obtaining 203 a gain function G based on a ratio between a measure of magnitude of the center channel audio signal C and the measure representing the overall magnitude of the multi-channel audio signal, weighting 205 the left channel audio signal L by the gain function G to obtain a weighted left channel audio signal $L_E$, weighting 207 the center channel audio signal C by the gain function G to obtain a weighted center channel audio signal $C_E$, weighting 209 the right channel audio signal R by the gain function G to obtain a weighted right channel audio signal $R_E$, combining 211 the left channel audio signal L with the weighted left channel audio signal $L_E$ to obtain a combined left channel audio signal $L_{EV}$, combining 213 the center channel audio signal C with the weighted center channel audio signal $C_E$ to obtain a combined center channel audio signal $C_{EV}$, and combining 215 the right channel audio signal R with the weighted right channel audio signal $R_E$ to obtain a combined right channel audio signal $R_{EV}$.

The signal processing method 200 can be performed by the signal processing apparatus 100, e.g. by the filter 101 and the combiner 103.

In the following, further implementation forms and embodiments of the signal processing apparatus 100 and the signal processing method 200 will be described.

The disclosure relates to the field of audio signal processing. The signal processing apparatus 100 and the signal processing method 200 can be applied for voice enhancement, e.g. dialogue enhancement, within audio signals, e.g. stereo audio signals. In particular, the signal processing apparatus 100 and the signal processing method 200 can, in combination with an up-mixer 301 or in combination with an up-mixer 301 and a down-mixer 303, be applied for processing stereo audio signals in order to improve dialogue clarity.

There are different devices having two loudspeakers, such as TVs, laptops, tablet computers, mobile phones, and smartphones. When stereo audio signals are played back using such devices, voice components of soundtracks from movies, for example, may be hard to understand for normal and hearing-impaired listeners. This is particularly the case in noisy environments or when the voice component is superimposed by non-voice components or sounds such as music or sound effects.

Embodiments of the disclosure aim, in particular, at enhancing the voice component of stereo audio signals in order to improve the dialogue clarity. One underlying assumption is that voice, or equivalently speech, is center-panned in a multi-channel audio signal, which is generally true for most of stereo audio signals. An object is to enhance the loudness of voice components without influencing the voice quality, while non-voice components are left unchanged. This should particularly be possible during time intervals with simultaneous voice and non-voice components. Embodiments of the disclosure allow, for example, to use only a stereo audio signal and do not need or employ further knowledge from a separate voice audio channel or an original 5.1 multi-channel audio signal. The goals are achieved by extracting a virtual center channel audio signal and enhancing this center channel audio signal as well as the other audio signals using the described signal processing apparatus 100 or signal processing method 200. Furthermore, an approach for voice activity detection can be employed in order to make sure that non-voice components may not be influenced by the processing. Other embodiments of the disclosure can be used to process other multi-channel audio signals, such as a 5.1 multi-channel audio signal.

Embodiments of the disclosure are based on the following approach, wherein from a stereo audio signal recording, the center channel audio signal is extracted using an up-mixing approach. This center channel audio signal can further be processed using voice enhancement and voice activity detection, in order to obtain an estimate of the original voice component. A feature of the approach can be that the voice component may not only be extracted from the center channel audio signal, but also from the remaining channel audio signals. Since the up-mixing process may not work perfectly, these remaining channel audio signals may still comprise a voice component. When the voice components are also extracted and boosted, the resulting output audio signal has an improved voice quality and wideness.

In the following, in particular embodiments of the disclosure for enhancing a voice component of a multi-channel audio signal LCR (comprising a center channel audio signal, a left channel audio signal, and a right channel audio signal), which is obtained from a two-channel stereo audio signal by 2-to-3-up-mixing, are described based on FIGS. 3 to 7.

However, embodiments of the disclosure are not limited to such multi-channel audio signals and may also comprise the processing of LCR three channel audio signals, e.g. received from other devices, or the processing of other multi-channel signals comprising a center channel audio signal, e.g. of 5.1 or 7.1 multichannel signals. Further embodiments may even be configured to process multi-channel signals, which do not comprise a center channel audio signal, e.g. a 4.0 multichannel signal comprising a left and a right audio channel signal and a left and right surround channel signal, by up-mixing the multi-channel signal to obtain a virtual center channel audio signal before applying the voice or dialogue enhancement with or without the voice activity detection.

Figure 3:
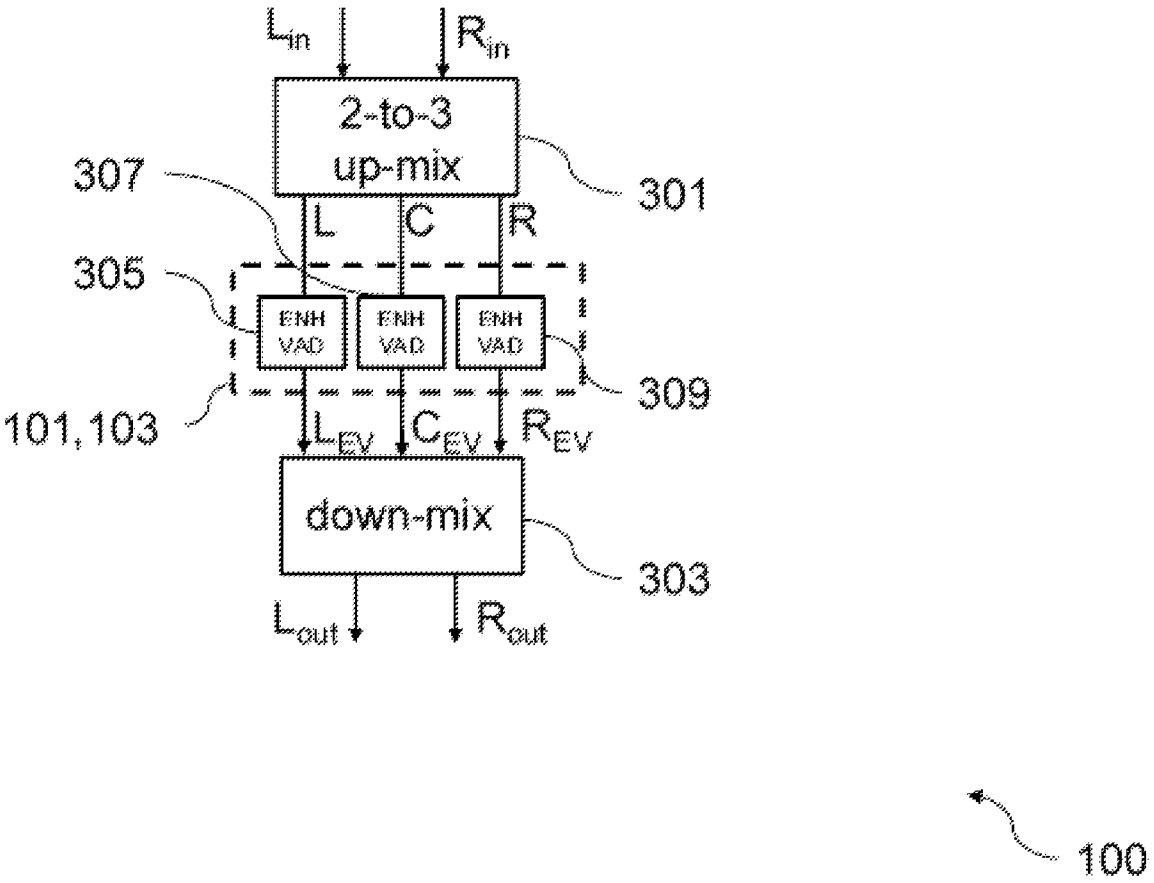
FIG. 3 shows a diagram of a signal processing apparatus for enhancing a voice component within a multi-channel audio signal according to an embodiment.

FIG. 3 shows a diagram of a signal processing apparatus 100 for enhancing a voice component within a multi-channel audio signal according to an embodiment. The signal processing apparatus 100 comprises a filter 101, a combiner 103, an up-mixer 301, and a down-mixer 303. The filter 101 and the combiner 103 comprise a left channel processor 305, a center channel processor 307, and a right channel processor 309.

The up-mixer 301 is configured to determine a left channel audio signal L, a center channel audio signal C, and a right channel audio signal R upon the basis of an input left channel stereo audio signal $L_{in}$ and an input right channel stereo audio signal $R_{in}$. In other words, the up-mixer 301 provides a 2-to-3 up-mix, as will be exemplarily explained in more detail based on FIG. 4.

The left channel processor 305 is configured to process the left channel audio signal L in order to provide the combined left channel audio signal $L_{EV}$. The center channel processor 307 is configured to process the center channel audio signal C in order to provide the combined center channel audio signal $C_{EV}$. The right channel processor 309 is configured to process the right channel audio signal R in order to provide the combined right channel audio signal $R_{EV}$. The left channel processor 305, the center channel processor 307, and the right channel processor 309 are configured to perform voice enhancement, ENH, as will be exemplarily explained in more detail based on FIG. 5. The left channel processor 305, the center channel processor 307, and the right channel processor 309 may additionally be configured to process a voice activity indicator provided by voice activity detection, VAD, as will be exemplarily explained in more detail based on FIG. 6.

The down-mixer 303 is configured to determine an output left channel stereo audio signal $L_{out}$ and an output right channel stereo audio signal $R_{out}$ upon the basis of the combined left channel audio signal $L_{EV}$, the combined center channel audio signal $C_{EV}$, and the combined right channel audio signal $R_{EV}$. In other words, the down-mixer 303 provides a 3-to-2 down-mix.

Thus, the voice-enhanced audio signals are processed in a way such that the down-mixed two-channel stereo signal $L_{out}$ and $R_{out}$ can be directly output to a conventional two-channel stereo playback device, e.g. a conventional stereo TV set.

In one embodiment of the disclosure, a common approach is used by the up-mixer 301 for center channel extraction from the input stereo audio signal comprising the input left channel stereo audio signal $L_{in}$ and the input right channel stereo audio signal $R_{in}$. This results in a left, center, and right channel audio signal, denoted as L, C, and R. Other embodiments of the disclosure can use other approaches for up-mixing. Further embodiments of the disclosure are conceivable, wherein e.g. a 5.1 multi-channel audio signal is available and the comprised left, center and right channels are directly used.

The left, center, and right channel audio signals L, C, and R are processed in an improved way to estimate a time and/or frequency dependent voice enhancement filter 101, which can then be applied on all channels of the multi-channel audio signal. This filter 101 is configured to attenuate non-voice components, which may be present simultaneously to the voice component. A difference with regard to other approaches is that not only the center channel audio signal, but also the other audio signals, e.g. the left channel audio signal and the right channel audio signal in the LCR case as depicted in FIG. 3, are processed with the same filter 101. Embodiments of the disclosure use an improved approach to define the voice enhancement filter 101.

Furthermore, voice activity detection can be performed using an improved approach, exploiting information from all channels of the multi-channel audio signal. The output of the voice activity detector, e.g. a voice activity indicator, can be a soft decision, which can indicate a voice activity. The combination of voice enhancement and voice activity detection provides a multi-channel audio signal, which only or at least almost only comprises the voice component. This voice component multi-channel audio signal can be boosted and added to the original multi-channel audio signal by the combiner 103 in order to obtain the combined channel audio signals $L_{EV}$, $C_{EV}$, and $R_{EV}$. A down-mix to stereo can be performed by the down-mixer 303 in order to provide the final output channel stereo audio signals $L_{out}$ and $R_{out}$.

Figure 4:
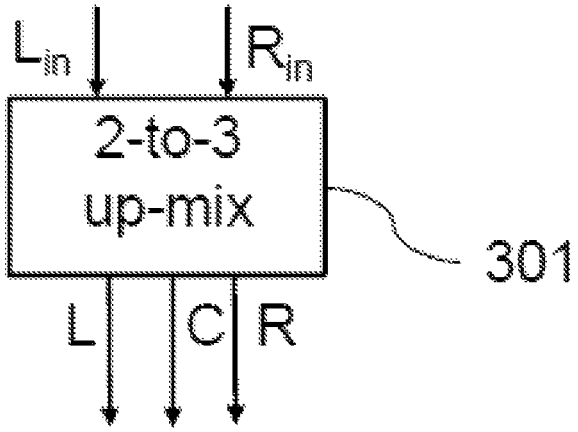
FIG. 4 shows a diagram of an up-mixer of a signal processing apparatus according to an embodiment.

FIG. 4 shows a diagram of an up-mixer 301 of a signal processing apparatus 100 according to an embodiment. The up-mixer 301 is configured to determine a left channel audio signal L, a center channel audio signal C, and a right channel audio signal R upon the basis of an input left channel stereo audio signal $L_{in}$ and an input right channel stereo audio signal $R_{in}$. The up-mixer 301 provides a 2-to-3 up-mix. The up-mixer 301 is configured to perform an extraction of the center channel audio signal C from an input two-channel stereo audio signal using an up-mixing approach.

The process for obtaining a virtual center channel audio signal C from, for example, a two-channel input stereo audio signal is also referred to as center extraction. This can be desired when only a conventional stereo audio signal of a recording is available. There are different approaches for achieving center extraction. One family of up-mixing approaches is based on matrix decoding. These approaches are linear signal-independent approaches for up-mixing. They can be coupled with a matrix decoder and work in time domain. Geometric approaches, on the other hand, are signal-dependent. These approaches can rely on the assumption that the left channel audio signal L and the right channel audio signal R are uncorrelated with regard to each other. These approaches work in the frequency domain.

In the following, a specific approach is described as an example for center extraction, which can be used in any embodiment of the disclosure. The approach is performed in frequency domain. This means that the input stereo audio signal is transformed into frequency domain e.g. by applying a discrete Fourier transform (DFT) algorithm on short-time windows. An appropriate choice for the block size of the discrete Fourier transform (DFT) can be 1024 when a sampling frequency of 48000 Hz is used.

The approach builds on the assumption that the left and right channel audio signals L and R are orthogonal with regard to each. The idea is to obtain the center channel audio signal C as $$C=\alpha\times(L_{in}+R_{in}) \tag{1}$$

wherein $\alpha$ is a parameter that is determined. The left and right channel audio signals L and R can then be derived as $$L=L_{in}-C \tag{2}$$

$$R=R_{in}-C \tag{3}$$

from the resulting center channel audio signal C. The parameter $\alpha$ can be optimized in a way to fulfill the constraint $$L\times R^*=0 \tag{4}$$

which describes an orthogonality of the audio signals. A mathematical solution to this problem can be derived, yielding the result $$\alpha = \frac{1}{2} \times \left(1 - \sqrt{\frac{(L_r - R_r)^2 + (L_i - R_i)^2}{(L_r + R_r)^2 + (L_i + R_i)^2}}\right) \quad (5)$$

wherein $L_r$, $L_i$, $R_r$ and $R_i$ denote real and imaginary parts of the spectral components of the input left and right stereo audio signals $L_{in}$ and $R_{in}$, respectively. The parameter $\alpha$ is time-dependent and frequency-dependent and can therefore be computed for all frequency bins of a given frame of audio signal samples.

Other specific geometric approaches for center extraction can be applied. Other specific approaches use, for example, a principal component analysis for center extraction.

Figure 5:
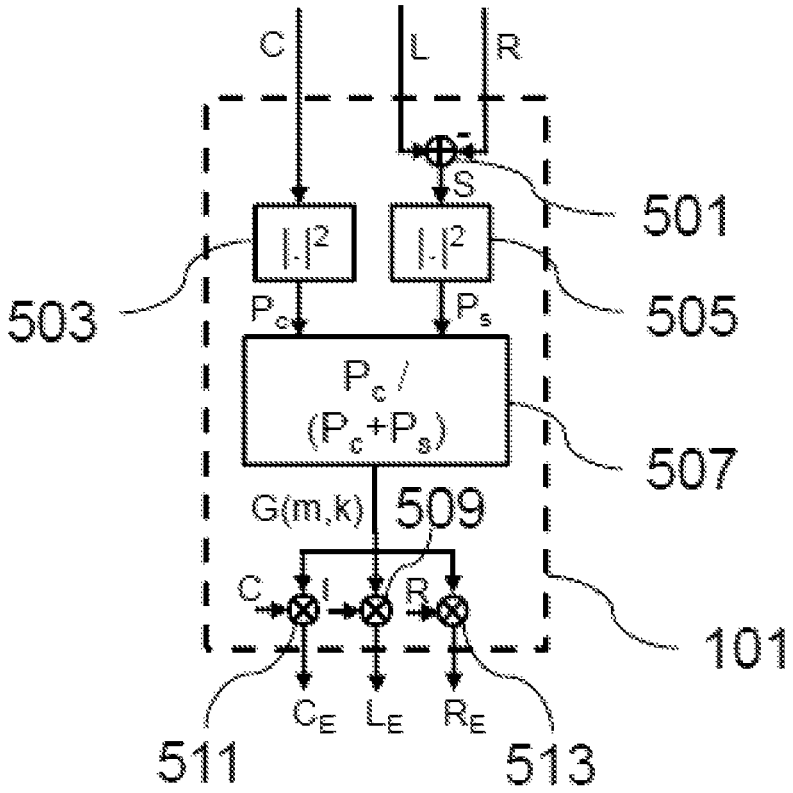
FIG. 5 shows a diagram of a filter of a signal processing apparatus according to an embodiment.

FIG. 5 shows a diagram of a filter 101 of a signal processing apparatus 100 according to an embodiment. The filter 101 comprises a subtractor 501, a determiner 503, a determiner 505, a determiner 507, a weighter 509, a weighter 511, and a weighter 513. The diagram illustrates the voice enhancement approach.

The subtractor 501 is configured to subtract the right channel audio signal R from the left channel audio signal L in order to obtain a residual audio signal S.

The determiner 503 is configured to determine a squared magnitude or power of the center channel audio signal C in order to obtain a measure of magnitude PC of the center channel audio signal C. The determiner 505 is configured to determine a squared magnitude or power of the residual audio signal S in order to obtain a measure of magnitude PS of the residual audio signal S.

The determiner 507 is configured to determine a ratio between the measure of magnitude PC of the center channel audio signal C and a measure representing the overall magnitude of the multi-channel audio signal to obtain the gain function G. The measure representing the overall magnitude of the multi-channel audio signal is formed by the sum of the measure of magnitude PC of the center channel audio signal C and the measure of magnitude PS of the residual audio signal S. The gain function G can be time-dependent and/or frequency-dependent. A sample time index is denoted as m. A frequency bin index is denoted as k.

The weighter 509 is configured to weight the left channel audio signal L by the gain function G to obtain a weighted left channel audio signal LE. The weighter 511 is configured to weight the center channel audio signal C by the gain function G to obtain a weighted center channel audio signal CE. The weighter 513 is configured to weight the right channel audio signal R by the gain function G to obtain a weighted right channel audio signal RE.

Embodiments of the disclosure use information from the left, center, and right channel audio signals L, C, and R to estimate the gain function G according to a Wiener filtering approach for voice enhancement. The Wiener filtering approach can be applied on all channels of the multi-channel audio signal in order to remove non-voice components. In case the center channel audio signal C comprises a voice component, the Wiener filtering approach (almost) only retains voice components of all channels of the multi-channel audio signal.

In general, the employed voice enhancement approach can address additive noise. Therefore, an input signal Y of any channel can be regarded as Y=X+N, wherein X comprises a clean voice component and N can be regarded as additive noise. It is assumed that X and N are uncorrelated with regard to each other. In order to remove N from the observed audio signal Y, a noise power spectral density of the additive noise N or an a-priori signal-to-noise ratio X/N can be estimated. A frequency-dependent gain function G or G(m,k) can then be obtained as $$G = \frac{\frac{X}{N}}{1 + \frac{X}{N}} = \frac{X}{X + N} \quad (6)$$

and an estimate of the audio signal comprising the clean voice component can be determined as $\hat{X}=G\times Y$, working on all frequency bins of the audio signal.

The voice enhancement approach exploits the assumption that the center channel audio signal C comprises mostly voice. Since usually no center extraction approach provides a perfect center extraction, the center channel audio signal C can comprise non-voice components and the other channels of the multi-channel audio signal may comprise voice components. Therefore, a goal is to remove the non-voice components in the center channel audio signal C and to isolate the voice components in the other channels of the multi-channel audio signal. In order to achieve this goal, the Wiener filtering approach can be applied in order to estimate the gain function G Instead of using complex approaches to estimate the noise power spectral density of the additive noise N, a simple yet efficient approach to define X and N for the Wiener filtering approach is used, as defined by equations (7), (8), and (9). The center channel audio signal C is regarded as comprising the voice component, corresponding to X, while the content of other channels of the multi-channel audio signal is regarded as to comprise noise, corresponding to N.

In an embodiment, a residual audio signal S is obtained from the left and right channel audio signals by the subtractor 501, e.g. according to S=L−R. In this way, center components are removed from the residual signal. The powers can be determined from the spectrum of the center channel audio signal C by the determiner 503 and the spectrum of the residual audio signal S by the determiner 505 according to $$P_C(m,k)=|C(m,k)|^2 \quad (7)$$

$$P_S(m,k)=|L(m,k)-R(m,k)|^2 \quad (8)$$

wherein m is a sample time index and k is a frequency bin index. Another possible approach is to use a magnitude instead of power, or a logarithmic magnitude or power. In further embodiments, the powers can be smoothed over time in order to reduce processing artifacts.

The gain function G is then determined by the determiner 507 according to the Wiener filtering approach according to $$G(m, k) = \frac{P_C(m, k)}{P_C(m, k) + P_S(m, k)} \quad (9)$$

The gain function G is subsequently applied to the left, center, and right channel audio signals L, C, and R by the weighters 509-513, respectively. This results in the weighted left channel audio signal $L_E$, the weighted center channel audio signal $C_E$, and the weighted right channel audio signal $R_E$.

In case the original center channel audio signal C comprises only a voice component, the enhanced weighted audio signals also comprise only voice components.

In an embodiment of the disclosure, a different multi-channel audio signal format is used. For an exemplary 5.1 multi-channel audio signal, an option to determine the residual audio signal S is $$S=L-R+L_S-R_S, \tag{10}$$

wherein L denotes the left channel audio signal, R denotes the right channel audio signal, $L_S$ denotes the left surround channel audio signal, and $R_S$ denotes the right surround channel audio signal. In another embodiment, the power $P_S$ can be determined as the sum of the power of L−R and the power of $L_S-R_S$.

The residual audio signal S and the power of the residual audio signal PS can be determined accordingly using other multi-channel audio signal formats, such as a 7.1 multi-channel audio signal format.

In order to further reduce the computational complexity, the frequency bins of the audio signals can be grouped together into frequency bands, e.g. according to a Mel frequency scale. In this case, the gain function G can be determined for each frequency bin.

Furthermore, processing only frequencies that may possibly comprise human voice, e.g. within the frequency range from 100 Hz to 8000 Hz, helps to filter out non-voice components.

Embodiments of the voice enhancement remove unwanted non-voice components that are leaked into the center channel audio signal C during the up-mixing process. In addition, it boosts direct components that are leaked into the other channels of the multi-channel audio signal.

Figure 6:
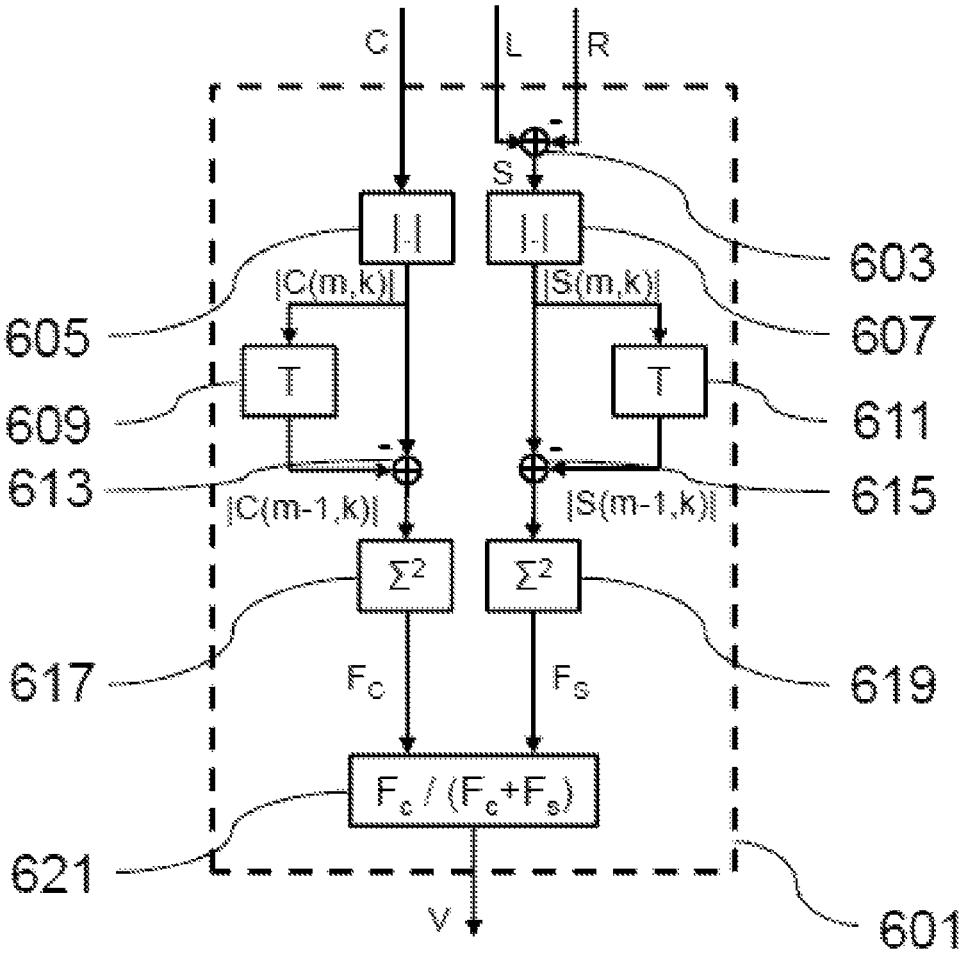
FIG. 6 shows a diagram of a voice activity detector of a signal processing apparatus according to an embodiment.

FIG. 6 shows a diagram of a voice activity detector 601 of a signal processing apparatus 100 according to an embodiment. The voice activity detector 601 is configured to determine a voice activity indicator V upon the basis of the left channel audio signal L, the center channel audio signal C, and the right channel audio signal R, wherein the voice activity indicator V indicates a magnitude of the voice component within the multi-channel audio signal over time. The voice activity detector 601 comprises a subtractor 603, a determiner 605, a determiner 607, a delayer 609, a delayer 611, a subtractor 613, a subtractor 615, a determiner 617, a determiner 619, and a determiner 621.

The subtractor 603 is configured to subtract the right channel audio signal R from the left channel audio signal L in order to obtain a residual audio signal S. The determiner 605 is configured to determine a magnitude of the center channel audio signal C to obtain |C(m,k)|, wherein m denotes a sample time index and k denotes a frequency bin index. The determiner 607 is configured to determine a magnitude of the residual audio signal S to obtain |S(m,k)|, wherein m denotes a sample time index and k denotes a frequency bin index. The delayer 609 is configured to delay |C(m,k)| by a sample time period to obtain |C(m−1,k)|. The delayer 611 is configured to delay |S(m,k)| by a sample time period to obtain |S(m−1,k)|. The subtractor 613 is configured to subtract |C(m−1,k)| from |C(m,k)| in order to obtain |C(m,k)|−|C(m−1,k)|. The subtractor 615 is configured to subtract |S(m−1,k)| from |S(m,k)| in order to obtain |S(m,k)|−|S(m−1,k)|.

The determiner 617 is configured to determine a measure of spectral variation FC of the center channel audio signal C, for example the spectral flux, e.g. upon the basis of a squared sum Σ2 over all frequency bins over |C(m,k)|−|C(m−1,k)|. The determiner 619 is configured to determine a measure of spectral variation FS of the difference between the left channel audio signal L and the right channel audio signal R, for example the spectral flux, e.g. upon the basis of a squared sum Σ2 over all frequency bins over |S(m,k)|−|S(m−1,k)|. The determiner 621 is configured to determine the voice activity indicator V upon the basis of the measure of spectral variation FC and the measure of spectral variation FS, e.g. upon the basis of the quotient FC/(FC+FS).

Voice activity detection comprises a process of temporal detection and segmentation of voice. The goal of voice activity detection is to detect voice in silence or among other sounds. Such an approach is desirable for almost any kind of voice technology.

Various other approaches for voice activity detection can be applied in embodiments of the disclosure. A simple approach is e.g. energy-based. Energy thresholding can be used to detect voice. Typically, such an approach is only effective for voice in silence. Other approaches comprise statistical model-based approaches, which are based on a signal-to-noise ratio (SNR) estimation and are similar to statistical voice enhancement approaches. Parametric model-based approaches usually couple low-level audio features with a classifier such as a Gaussian mixture model. Possible audio features are the 4 Hz modulation energy, the zero crossing rate, the spectral centroid, or the spectral flux.

In an embodiment of the disclosure, voice activity detection is employed to make sure that only voice or dialogue components are boosted and non-voice components are left unchanged. An overview of the voice enhancement approach is given in FIG. 6.

The voice activity indicator V is derived from the center channel audio signal C and the residual audio signal S=L−R, as it can be done within the voice enhancement approach. From these audio signals, the spectral flux is extracted. The spectral flux is a measure for the temporal variation of the spectrum. The spectral flux of a DFT or frequency domain signal X can be defined as $$F_X(m)=\sum_k (|X(m,k)|-|X(m-1,k)|)^2 \tag{11}$$

Other similar definitions of the spectral flux can also be employed in further embodiments of the disclosure. The spectral flux indicates changes in the spectral energy distribution and represents a temporal derivative over time. Instead of the definition in equation (11), wherein a difference is determined over two consecutive audio signal frames, the spectral flux can also be determined as a difference over two consecutive blocks containing multiple audio signal frames. For audio signals having voice components, higher values of the spectral flux are expected compared to music and other sounds.

In an embodiment of the disclosure, the specific channel setup, wherein e.g. one channel of the multi-channel audio signal comprises primarily voice, is exploited in order to derive a frequency-independent continuous voice activity indicator V. The spectral flux FC of the center channel audio signal C and the spectral flux FS of the residual audio signal S can then be determined according to equation (11).

In order to obtain a voice activity indicator V that is independent of any normalization process, the voice activity indicator V can e.g. be computed as $$V=a\times\left(\frac{F_c}{F_c+F_s}-0.5\right) \tag{12}$$

This definition of the voice activity indicator V ensures that V=0 in case that $F_C=F_S$. Finally, V is limited to $V\in[0;1]$. The parameter a denotes a predetermined scaling factor which controls the dynamic range of V, wherein a=4 can be an acceptable value yielding $$V = 4\times\left(\frac{F_c}{F_c+F_s}-0.5\right) \tag{13}$$

Furthermore, the voice activity indicator V can be set to V=0 in case that $F_C$ does not exceed a certain threshold t. In order to obtain a smooth voice activity indicator curve over time, a temporal smoothing can be applied to V.

Similarly to the voice enhancement approach, the voice activity detection approach can also be performed when the frequency bins are grouped into frequency bands, e.g. according to a Mel frequency scale. In addition, limiting the considered frequencies to a frequency range of human voice, e.g. 100 to 8000 Hz, further improves the performance.

The result of the voice activity detection approach is a frequency-independent continuous decision which is obtained using a simple and efficient algorithm. It may employ only a few tunable parameters and may not use any further data, for example to learn a model. The approach can robustly discriminate between voice and other sounds, such as music.

Figure 7:
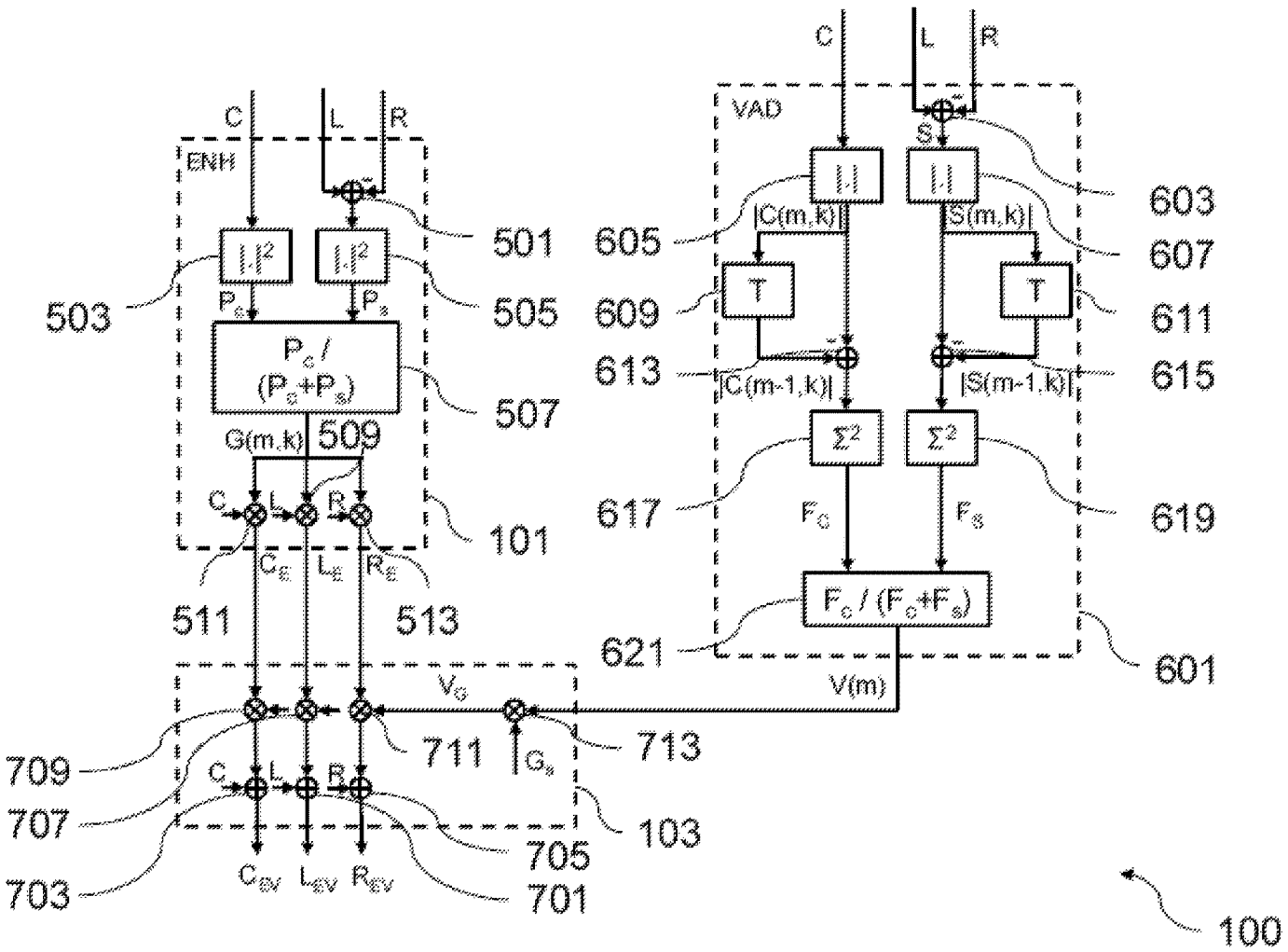
FIG. 7 shows a diagram of a signal processing apparatus for enhancing a voice component within a multi-channel audio signal according to an embodiment.

FIG. 7 shows a diagram of a signal processing apparatus 100 for enhancing a voice component within a multi-channel audio signal according to an embodiment. The diagram illustrates a mixing process. The signal processing apparatus 100 forms a possible implementation of the signal processing apparatus as described in conjunction with FIG. 1. The signal processing apparatus 100 comprises a filter 101, a combiner 103, and a voice activity detector 601.

The filter 101 provides the functionality described in conjunction with the filter 101 in FIG. 5. The voice activity detector 601 provides the functionality described in conjunction with the voice activity detector 601 in FIG. 6.

In an embodiment, the combiner 103 is configured to combine the left channel audio signal L with the weighted left channel audio signal LE to obtain a combined left channel audio signal LEV, to combine the center channel audio signal C with the weighted center channel audio signal CE to obtain a combined center channel audio signal CEV, and to combine the right channel audio signal R with the weighted right channel audio signal RE to obtain a combined right channel audio signal REV. The combiner comprises an adder 701, an adder 703, an adder 705, a weighter 707, a weighter 709, a weighter 711, and a weighter 713.

In an embodiment, the weighter 713 is configured to weight the voice activity indicator V(m) by a predetermined speech gain factor GS to obtain a weighted voice activity indicator VG=GS V(m), wherein m denotes a sample time index. The combiner can comprise a further weighter, which is not shown in the figure, being configured to weight the left channel audio signal L, the center channel audio signal C, and the right channel audio signal R by a predetermined input gain factor Gin.

The weighter 707 is configured to weight the weighted left channel audio signal LE with the weighted voice activity indicator VG=GS V(m), and the adder 701 is configured to add the result to the left channel audio signal L to obtain the combined left channel audio signal LEV. The weighter 709 is configured to weight the weighted center channel audio signal CE with the weighted voice activity indicator VG=GS V(m), and the adder 703 is configured to add the result to the center channel audio signal C to obtain the combined center channel audio signal CEV. The weighter 711 is configured to weight the weighted right channel audio signal RE with the weighted voice activity indicator VG=GS V(m), and the adder 705 is configured to add the result to the right channel audio signal R to obtain the combined right channel audio signal REV.

In an embodiment, the weighter 713 is configured to weight the weighted left channel audio signal LE, the weighted center channel audio signal CE, and the weighted right channel audio signal RE by a predetermined speech gain factor GS. The combiner 103 can comprise a further weighter, which is not shown in the figure, being configured to weight the left channel audio signal L, the center channel audio signal C, and the right channel audio signal R by a predetermined input gain factor Gin.

The predetermined speech gain factor GS can also be applied in case that the voice activity detector 601 is not used. For simplicity, the weighter 713 is shown as a single weighter 713 in the figure. In a possible implementation, the weighter 713 is used three times, in particular between the weighter 709 and the adder 703, between the weighter 707 and the adder 701, and between the weighter 711 and the adder 705. In case that the voice activity detector 601 is not used, V=1 can be assumed, and GS can be used to modify V.

The results of voice enhancement and voice activity detection can therefore be combined in order to obtain an estimate of a clean voice audio signal. Voice enhancement and voice activity detection can be performed in parallel as described. The voice activity indicator V can be weighted or multiplied by the weighter 713 with the speech gain factor GS, wherein VG=V GS can be used to control the voice boost. VG can be combined by the weighters 707, 709, 711 in a multiplicative way with the weighted audio signals LE, CE, and RE and the resulting audio signals can be added by the adders 701, 703, 705 to the original audio signals L, C, and R in order to obtain the final combined audio signals LEV, CEV, and REV of the signal processing apparatus 100 according to the following equations:

$$C_{EV}(m,k)=G_{in}\times C+G_S\times V(m)\times G(m,k)\times C(m,k) \tag{14}$$

$$L_{EV}(m,k)=G_{in}\times L+G_S\times V(m)\times G(m,k)\times L(m,k) \tag{15}$$

$$R_{EV}(m,k)=G_{in}\times R+G_S\times V(m)\times G(m,k)\times R(m,k) \tag{16}$$

wherein $G_{in}$ is an input gain factor that is applied on the original audio signals. This factor controls the gain of non-voice components comprised by the multi-channel audio signal. Specific combinations of $G_{in}$ and $G_S$, e.g. $G_{in}=1$ and $G_S=-1$, can be used to remove the voice component from the multi-channel audio signal. Appropriate settings to boost the voice component can be $G_{in}=1$ while $G_S$ may be in the range between 1 and 4. The final combined audio signals $L_{EV}$, $C_{EV}$, and $R_{EV}$ can then be transformed back to the time domain and can be used to create a stereo down-mix.

Consequently, a computationally inexpensive and yet efficient solution to the problem of voice or dialogue enhancement is provided. All components can operate in the DFT frequency domain. Compared to a simple approach where the center channel audio signal C, e.g. in a 5.1 surround audio signal, is boosted and all sounds within the center channel audio signal C are enhanced, in embodiments of the disclosure only voice components in the center channel audio signal C are boosted, e.g. due to the voice activity detection. Furthermore, embodiments of the disclosure also handle simultaneous voice and non-voice components, wherein only the voice components are boosted e.g. because of the voice enhancement approach.

The fact that not only the center channel audio signal C, but also the other audio signals (e.g. L and R) are processed using voice enhancement and voice activity detection, ensures that the final audio signals comprise a spatially wide voice component with a high quality. This is not the case when only the center channel audio signal C is processed. Embodiments of the disclosure are independent of a specific codec, mix, or multi-channel audio signal format, such as a 5.1 surround audio signal, and can be extended to different channel configurations.

Embodiments of the disclosure, and in particular of the signal processing apparatus, may comprise a single or multiple processors configured to implement the various functionalities of the apparatus and the methods described herein, e.g. of the filter 101, the combiner 103 and/or the other units or steps described herein based on FIGS. 1 to 7.

Depending on certain implementation requirements of the inventive methods, the inventive methods can be implemented in hardware or in software or in any combination thereof.

The implementations can be performed using a digital storage medium, in particular a floppy disc, CD, DVD or Blu-Ray disc, a ROM, a PROM, an EPROM, an EEPROM or a Flash memory having electronically readable control signals stored thereon which cooperate or are capable of cooperating with a programmable computer system such that an embodiment of at least one of the inventive methods is performed.

A further embodiment of the present disclosure is or comprises, therefore, a computer program product with a program code stored on a machine-readable carrier, the program code being operative for performing at least one of the inventive methods when the computer program product runs on a computer.

In other words, embodiments of the inventive methods are or comprise, therefore, a computer program having a program code for performing at least one of the inventive methods when the computer program runs on a computer, on a processor or the like.

A further embodiment of the present disclosure is or comprises, therefore, a machine-readable digital storage medium, comprising, stored thereon, the computer program operative for performing at least one of the inventive methods when the computer program product runs on a computer, on a processor or the like.

A further embodiment of the present disclosure is or comprises, therefore, a data stream or a sequence of signals representing the computer program operative for performing at least one of the inventive methods when the computer program product runs on a computer, on a processor or the like.

A further embodiment of the present disclosure is or comprises, therefore, a computer, processor or any other programmable logic device adapted to perform at least one of the inventive methods.

A further embodiment of the present disclosure is or comprises, therefore, a computer, processor or any other programmable logic device having stored thereon the computer program operative for performing at least one of the inventive methods when the computer program product runs on the computer, processor or the any other programmable logic device, e.g. a FPGA (Field Programmable Gate Array) or an ASIC (Application Specific Integrated Circuit).

While the aforegoing was particularly shown and described with reference to particular embodiments thereof, it is to be understood by those skilled in the art that various other changes in the form and details may be made, without departing from the spirit and scope thereof. It is therefore to be understood that various changes may be made in adapting to different embodiments without departing from the broader concept disclosed herein and comprehended by the claims that follow.

What is claimed is:

1. A signal processing apparatus for enhancing a voice component within a multi-channel audio signal, the multi-channel audio signal comprising a left channel audio signal (L), a center channel audio signal (C), and a right channel audio signal (R), the signal processing apparatus comprising:

a filter configured to:

determine a measure representing an overall magnitude of the multi-channel audio signal over frequency based on the left channel audio signal (L), the center channel audio signal (C), and the right channel audio signal (R), obtain a gain function (G) based on a ratio between a measure of magnitude of the center channel audio signal (C) and the measure representing the overall magnitude of the multi-channel audio signal, wherein the gain function is frequency dependent, weight the left channel audio signal (L) by the gain function (G) to obtain a weighted left channel audio signal ($L_E$), weight the center channel audio signal (C) by the gain function (G) to obtain a weighted center channel audio signal ($C_E$), and weight the right channel audio signal (R) by the gain function (G) to obtain a weighted right channel audio signal ($R_E$); and a combiner configured to:

combine the left channel audio signal (L) with the weighted left channel audio signal ($L_E$) to obtain a combined left channel audio signal ($L_{EV}$), combine the center channel audio signal (C) with the weighted center channel audio signal ($C_E$) to obtain a combined center channel audio signal ($C_{EV}$), and combine the right channel audio signal (R) with the weighted right channel audio signal ($R_E$) to obtain a combined right channel audio signal ($R_{EV}$).

2. The signal processing apparatus of claim 1, wherein the filter is further configured to determine the measure representing the overall magnitude of the multi-channel audio signal as a sum of the measure of magnitude of the center channel audio signal (C) and a measure of magnitude of a difference of the left channel audio signal (L) and the right channel audio signal (R).

3. The signal processing apparatus of claim 1, wherein the filter is configured to determine the gain function (G) according to the following equations:

$$G(m,k) = \frac{P_C(m,k)}{P_C(m,k) + P_S(m,k)}$$

$$P_C(m,k) = |C(m,k)|^2$$

$$P_S(m,k) = |L(m,k) - R(m,k)|^2$$

wherein G denotes the gain function, L denotes the left channel audio signal, C denotes the center channel audio signal, R denotes the right channel audio signal, $P_C$ denotes a power of the center channel audio signal (C) as the measure representing a magnitude of the center channel audio signal (C), $P_S$ denotes a power of a difference between the left channel audio signal (L) and the right channel audio signal (R), and the sum of $P_C$ and $P_S$ denotes the measure representing the overall magnitude of the multi-channel audio signal, m denotes a sample time index, and k denotes a frequency bin index.

4. The signal processing apparatus of claim 1, wherein the multi-channel audio signal further comprises a left surround channel audio signal (LS) and a right surround channel audio signal (RS), wherein the filter is further configured to:

determine the measure representing the overall magnitude of the multi-channel audio signal over frequency additionally based on the left surround channel audio signal (LS) and the right surround channel audio signal (RS), and determine the measure representing the overall magnitude of the multi-channel audio signal as the sum of the measure of magnitude of the center channel audio signal (C), of a measure of magnitude of a difference of the left channel audio signal (L) and the right channel audio signal (R), and of a measure of magnitude of a difference of the left surround channel audio signal (LS) and the right surround channel audio signal (RS).

5. The signal processing apparatus of claim 1, further comprising:

a voice activity detector configured to determine a voice activity indicator (V) based on the left channel audio signal (L), the center channel audio signal (C), and the right channel audio signal (R), the voice activity indicator (V) indicating a magnitude of the voice component within the multi-channel audio signal over time, wherein the combiner is further configured to:

combine the weighted left channel audio signal ($L_E$) with the voice activity indicator (V) to obtain the combined left channel audio signal ($L_{EV}$), combine the weighted center channel audio signal ($C_E$) with the voice activity indicator (V) to obtain the combined center channel audio signal ($C_{EV}$), and combine the weighted right channel audio signal ($R_E$) with the voice activity indicator (V) to obtain the combined right channel audio signal ($R_{EV}$).

6. The signal processing apparatus of claim 5, wherein the voice activity detector is further configured to:

determine a measure representing an overall spectral variation of the multi-channel audio signal based on the left channel audio signal (L), the center channel audio signal (C), and the right channel audio signal (R); and obtain the voice activity indicator (V) based on a ratio between a measure of spectral variation ($F_c$) of the center channel audio signal (C) and the measure representing the overall spectral variation of the multi-channel audio signal.

7. The signal processing apparatus of claim 6, wherein the voice activity detector is further configured to determine the voice activity indicator (V) according to the following equation:

$$V = a \times \left(\frac{F_c}{F_c + F_s} - 0.5\right)$$

wherein V denotes the voice activity indicator, $F_C$ denotes the measure of spectral variation of the center channel audio signal (C), $F_S$ denotes a measure of spectral variation of a difference between the left channel audio signal (L) and the right channel audio signal (R), and the sum of $F_C$ and $F_S$ denotes the measure representing the overall spectral variation of the multi-channel audio signal, and a denotes a predetermined scaling factor.

8. The signal processing apparatus of claim 7, wherein the voice activity detector is further configured to determine the measure of spectral variation ($F_c$) of the center channel audio signal (C) as the spectral flux and the measure of spectral variation ($F_S$) of the difference between the left channel audio signal (L) and the right channel audio signal (R) as the spectral flux according to the following equations:

$$F_C(m) = \sum_k (|C(m,k)| - |C(m-1,k)|)^2$$

$$F_S(m) = \sum_k (|S(m,k)| - |S(m-1,k)|)^2$$

wherein $F_C$ denotes the spectral flux of the center channel audio signal (C), $F_S$ denotes the spectral flux of the difference between the left channel audio signal (L) and the right channel audio signal (R), C denotes the center channel audio signal, S denotes the difference between the left channel audio signal (L) and the right channel audio signal (R), m denotes a sample time index, and k denotes a frequency bin index.

9. The signal processing apparatus of claim 5, wherein the voice activity detector is further configured to filter the voice activity indicator (V) in time based on a predetermined low-pass filtering function.

10. The signal processing apparatus of claim 5, wherein the combiner is further configured to:

weight the left channel audio signal (L), the center channel audio signal (C), and the right channel audio signal (R) by a predetermined input gain factor ($G_{in}$); and weight the voice activity indicator (V) by a predetermined speech gain factor ($G_S$).

11. The signal processing apparatus of claim 5, wherein the combiner is further configured to:

add the left channel audio signal (L) to the combination of the weighted left channel audio signal ($L_E$) with the voice activity indicator (V) to obtain the combined left channel audio signal ($L_{EV}$);

add the center channel audio signal (C) to the combination of the weighted left channel audio signal ($L_E$) with the voice activity indicator (V) to obtain the combined center channel audio signal ($C_{EV}$); and add the right channel audio signal (R) to the combination of the weighted left channel audio signal ($L_E$) with the voice activity indicator (V) to obtain the combined right channel audio signal ($R_{EV}$).

12. The signal processing apparatus of claim 1, further comprising:

an up-mixer configured to determine the left channel audio signal (L), the center channel audio signal (C), and the right channel audio signal (R) based on an input left channel stereo audio signal ($L_{in}$) and an input right channel stereo audio signal ($R_{in}$).

13. The signal processing apparatus of claim 12, further comprising:

a down-mixer configured to determine an output left channel stereo audio signal ($L_{out}$) and an output right channel stereo audio signal ($R_{out}$) based on the combined left channel audio signal ($L_{EV}$), the combined center channel audio signal ($C_{EV}$), and the combined right channel audio signal ($R_{EV}$).

14. The signal processing apparatus of claim 1, further comprising:

a down-mixer configured to determine an output left channel stereo audio signal ($L_{out}$) and an output right channel stereo audio signal ($R_{out}$) based on the combined left channel audio signal ($L_{EV}$), the combined center channel audio signal ($C_{EV}$), and the combined right channel audio signal ($R_{EV}$).

15. The signal processing apparatus of claim 1, wherein the measure of magnitude comprises a power, a logarithmic power, a magnitude, or a logarithmic magnitude of a signal.

16. A signal processing method for enhancing a voice component within a multi-channel audio signal, the multi-channel audio signal comprising a left channel audio signal (L), a center channel audio signal (C), and a right channel audio signal (R), the signal processing method comprising:

determining a measure representing an overall magnitude of the multi-channel audio signal over frequency based on the left channel audio signal (L), the center channel audio signal (C), and the right channel audio signal (R);

obtaining a gain function (G) based on a ratio between a measure of magnitude of the center channel audio signal (C) and the measure representing the overall magnitude of the multi-channel audio signal, wherein the gain function is frequency dependent;

weighting the left channel audio signal (L) by the gain function (G) to obtain a weighted left channel audio signal ($L_E$);

weighting the center channel audio signal (C) by the gain function (G) to obtain a weighted center channel audio signal ($C_E$);

weighting the right channel audio signal (R) by the gain function (G) to obtain a weighted right channel audio signal ($R_E$);

combining the left channel audio signal (L) with the weighted left channel audio signal ($L_E$) to obtain a combined left channel audio signal ($L_{EV}$);

combining the center channel audio signal (C) with the weighted center channel audio signal ($C_E$) to obtain a combined center channel audio signal ($C_{EV}$); and combining the right channel audio signal (R) with the weighted right channel audio signal ($R_E$) to obtain a combined right channel audio signal ($R_{EV}$).

17. A computer readable medium comprising a program code that, when executed by a processor, causes a computer system to enhance a voice component within a multi-channel audio signal, the multi-channel audio signal comprising a left channel audio signal (L), a center channel audio signal (C), and a right channel audio signal (R), by performing the following:

determining a measure representing an overall magnitude of the multi-channel audio signal over frequency based on the left channel audio signal (L), the center channel audio signal (C), and the right channel audio signal (R);

obtaining a gain function (G) based on a ratio between a measure of magnitude of the center channel audio signal (C) and the measure representing the overall magnitude of the multi-channel audio signal, wherein the gain function is frequency dependent;

weighting the left channel audio signal (L) by the gain function (G) to obtain a weighted left channel audio signal ($L_E$);

weighting the center channel audio signal (C) by the gain function (G) to obtain a weighted center channel audio signal ($C_E$);

weighting the right channel audio signal (R) by the gain function (G) to obtain a weighted right channel audio signal ($R_E$);

combining the left channel audio signal (L) with the weighted left channel audio signal ($L_E$) to obtain a combined left channel audio signal ($L_{EV}$);

combining the center channel audio signal (C) with the weighted center channel audio signal ($C_E$) to obtain a combined center channel audio signal ($C_{EV}$); and combining the right channel audio signal (R) with the weighted right channel audio signal ($R_E$) to obtain a combined right channel audio signal ($R_{EV}$).

18. The signal processing method of claim 16, wherein determining the measure representing the overall magnitude of the multi-channel audio signal includes summing a measure of magnitude of the center channel audio signal (C) and a measure of magnitude of a difference of the left channel audio signal (L) and the right channel audio signal (R).

19. The signal processing method of claim 16, wherein the measure of magnitude comprises a power, a logarithmic power, a magnitude, or a logarithmic magnitude of a signal.

20. The computer readable medium of claim 17, wherein the measure of magnitude comprises a power, a logarithmic power, a magnitude, or a logarithmic magnitude of a signal.

* * * * *